US012179970B2

(12) United States Patent
Smith

(10) Patent No.: US 12,179,970 B2
(45) Date of Patent: Dec. 31, 2024

(54) CONTAINER FOR STORAGE OF MOLTEN MATERIAL FROM AN INDUSTRIAL FACILITY AND METHOD OF MANUFACTURING SAME

(71) Applicant: ATKINS NUCLEAR SECURED HOLDINGS CORPORATION, Oak Ridge, TN (US)

(72) Inventor: Eric C. Smith, Columbia, MD (US)

(73) Assignee: ATKINS NUCLEAR SECURED HOLDINGS CORPORATION, Oak Ridge, TN (US)

( * ) Notice: Subject to any disclaimer, the term of this patent is extended or adjusted under 35 U.S.C. 154(b) by 0 days.

(21) Appl. No.: 18/329,366

(22) Filed: Jun. 5, 2023

(65) Prior Publication Data

US 2023/0322433 A1 Oct. 12, 2023

Related U.S. Application Data

(63) Continuation of application No. 16/662,006, filed on Oct. 23, 2019, now Pat. No. 11,718,444.

(Continued)

(51) Int. Cl.

| | |
|---|---|
| ***B65D 5/00*** | (2006.01) |
| ***B65D 5/32*** | (2006.01) |
| ***B65D 85/00*** | (2006.01) |

(52) U.S. Cl.

CPC ..... *B65D 5/323* (2013.01); *B65D 85/70* (2013.01)

(58) Field of Classification Search

CPC ..... B65B 1/04

See application file for complete search history.

(56) References Cited

U.S. PATENT DOCUMENTS 3,433,694 A * 3/1969 Nuttall ..... B65B 11/52 53/433

3,564,808 A * 2/1971 Kent ..... B65B 63/08 53/493

(Continued)

FOREIGN PATENT DOCUMENTS

WO WO 2018/181574 10/2018

OTHER PUBLICATIONS

NBS Special Publication 260-23, Standard Reference Materials, Viscosity of Standard Borosilicate Glass, U.S. Department of Commerce, National Bureau of Standards, Washington, D.C., 1970.

*Primary Examiner* — Eyamindae C Jallow

(74) *Attorney, Agent, or Firm* — Norton Rose Fulbright US LLP

(57) ABSTRACT

A container for storage of molten material from an industrial facility, and method of manufacture thereof, is provided to maximize internal volume of the container while providing structural stability. The container includes walls having rounded convex-shaped edges at each wall junction. A first head is connected to the walls at a first end of the container, and a second head closes the second end of the container. The second head is connected to the walls at a second end of the container. Corners are defined at the intersection of the walls with the first head and second head at the first end and the second end respectively. A first flange is connected to the first head to receive molten material, and the first head is shaped as a tapered shoulder to smoothly transition from the first flange to the junction of the walls.

10 Claims, 19 Drawing Sheets

Related U.S. Application Data

(60) Provisional application No. 62/749,638, filed on Oct. 23, 2018.

(56) References Cited

U.S. PATENT DOCUMENTS

| | | | | | |
|---|---|---|---|---|---|
| 5,505,041 | A * | 4/1996 | Harlan | A45D 40/16 | 401/175 |
| 5,725,820 | A * | 3/1998 | Reynolds | B65B 63/08 | 53/410 |
| 6,006,497 | A * | 12/1999 | Waver | B65D 75/002 | 264/264 |
| 6,533,564 | B1 * | 3/2003 | Haas | B29C 48/6916 | 425/72.1 |
| 2010/0247823 | A1 * | 9/2010 | Howell | B32B 27/32 | 53/469 |
| 2010/0251671 | A1 * | 10/2010 | Thompson | B65B 63/08 | 53/127 |
| 2014/0110912 | A1 | 4/2014 | Primiano | | |
| 2015/0144626 | A1 | 5/2015 | Jones et al. | | |
| 2018/0127175 | A1 | 5/2018 | Daley | | |

* cited by examiner

CONTAINER FOR STORAGE OF MOLTEN MATERIAL FROM AN INDUSTRIAL FACILITY AND METHOD OF MANUFACTURING SAME

CROSS-REFERENCE TO RELATED APPLICATIONS

This application is a continuation of U.S. patent application Ser. No. 16/662,006, filed Oct. 23, 2019, which claims the benefit including priority to U.S. Provisional Patent Application No. 62/749,638, filed Oct. 23, 2018, the entirety of each of which is hereby incorporated by reference.

FIELD OF INVENTION

Aspects of the present disclosure relate to industrial storage, and in particular, to methods and containers for storing molten matter.

BACKGROUND

Industrial processes can generate by-products or material, which must be contained, transported, and stored for periods of time. Some processes involve storing materials in a glass matrix or reducing glass tubes or other tools into a more storage-friendly form.

In some systems, molten material, such as glass, is poured into a container and allowed to cool, forming a solid matrix.

SUMMARY

In some embodiments, a container is designed to be structurally strong enough to receive molten material at very high temperatures and to avoid distortion and/or loss of containment.

According to an aspect of the present disclosure, there is a provided a container for storage of molten material from an industrial facility.

An example container for storage of molten material comprises a first wall opposing a second wall, and sidewalls joining the first wall and the second wall at rounded convex-shaped edges at each junction of the first wall and second with the sidewalls; a first head connected to the first wall, second wall, and sidewalls at a first end of the container; a second head closing the second end of the container, the second connected to the first wall, second wall, and sidewalls at a second end of the container; corners defined at the intersection of the first wall and second wall with each of the sidewalls at the first end and the second end; and a first flange connected to the first head, the first head shaped as a tapered shoulder to smoothly transition from the first flange to the junction of the first wall and second with the sidewalls; wherein the container defines an internal volume.

In an embodiment, the second head has a height extending along a longitudinal same axis of the container extending in the same direction as the first wall, second wall, and sidewall.

In an embodiment, the second head has a circular cross-section when viewed along a longitudinal axis of the container.

In an embodiment, the first flange has an outside diameter and an inner diameter defining an aperture.

In an embodiment, the container further comprising a second flange connected to the second head.

In an embodiment, the second head has a concave shape.

In an embodiment, the corners are rounded.

In an embodiment, the first wall, second wall, and sidewalls are concave. The first wall, second wall, and sidewalls may have a radius of curvature configured to maximize the internal volume while operating below a maximum allowable stress, strain, and distortion values permitted by design code when in use.

In an embodiment, the first wall, second wall, and sidewalls are flat.

In an embodiment, the first wall, second wall, and sidewalls define a generally square cross-section when the second end faces downward.

In an embodiment, the container is free of internal structures to support the container.

In an embodiment, the material is molten glass.

In an embodiment, the rounded convex-shaped edges resist forces that distort the container when the container is filled with high temperature material, distribute load of weight placed on top the container, and maximize the internal volume.

In an embodiment, a volume to surface area ratio of a portion of the container is greater than 1, the portion defined by the first wall, second wall, and sidewall.

In an embodiment, the corners have a radius of curvature configured to maximize the volume to surface area ratio of the container, and minimize a flow path length of the container.

According to another aspect of the present disclosure, there is a provided a method of manufacturing a container for storage of molten material.

An example method of manufacturing a container for storage of molten material comprises: hydroforming a first sheet of material to form a first head of the container; hydroforming a second sheet of material to form a second head of the container; forming a four walls each having a two lateral edges, the walls having a profile; forming a first flange from a sheet of material, the first flange having an inner surface to couple with a spout to receive molten material; connecting the lateral edges of the four walls to form a shell having a first edge and a second edge; connecting the first head to the first edge, and the second head to the second edge; and connecting the first flange to the first head, wherein four of the lateral edges of the walls have a rounded convex profile and form vertical edges of the container, and wherein the first head is shaped as a tapered shoulder to smoothly transition from the first flange to the junction with the walls.

In an embodiment, the second head has a height extending along the same axis as the first wall, second wall, and sidewall.

In an embodiment, the second head has a circular cross-section when the second end faces downward.

In an embodiment, the first sheet and the second sheet are each single uniform sheets.

In an embodiment, the container is made of stainless steel.

In an embodiment, a volume to surface area ratio of a portion of the container is greater than 1, the portion defined by the four walls of the container.

In an embodiment, the shell has a generally square-shaped cross-section.

In an embodiment, the profile is at least one of flat, convex, concave, or a combination thereof.

In an embodiment, the rounded convex profile of the lateral edges have a radius configured to maximize the volume to surface area ratio of the container.

In an embodiment, the four walls each have a radius of curvature configured to maximize an internal volume of the container while operating below the maximum allowable stress, strain, and distortion values permitted by design code when in use.

An example method of filling a container with molten material from an industrial facility comprises: positioning the container under a discharge location of a melter; pouring molten material from the melter into the container at a rate equal to or greater than a minimum rate required for the molten material to travel a flow path length; wherein the flow path length is a distance between the point at which the molten material is poured and a furthest sidewall. In an embodiment, the distance is in a horizontal plane.

In an embodiment of the method of filling a container with molten material, the molten material is poured generally along a longitudinal axis of the container, and the distance of the flow path length is approximately from the longitudinal axis of the container to the furthest sidewall.

In another embodiment of the method of filling a container with molten material, the molten material is poured into the container at a rate below a maximum rate defined by maximum allowable stress, strain, and distortion values permitted by design code.

In another embodiment of the method of filling a container with molten material, the molten material comprises molten glass.

In another embodiment of the method of filling a container with molten material, the method comprises coupling the container to the melter.

In another embodiment of the method of filing a container with molten material, the rate is selected based on at least one of the flow path length, a volume to surface area ratio of the container, a radius of curvature of a vertical edge of the container, viscosity and temperature of the molten material, or a combination thereof.

Embodiments according to the present disclosure may include combinations of the above features.

The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the terms "substantially" and "approximately" may be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," "include" and any form thereof such as "includes" and "including," and "contain" and any form thereof such as "contains" and "containing" are open-ended linking verbs. As a result, an apparatus that "comprises," "has," "includes," or "contains" one or more elements possesses those one or more elements, but is not limited to possessing only those one or more elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/have/include/contain—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale, unless otherwise noted, meaning the sizes of the depicted elements in each are accurate relative to each other for at least the embodiment in the figure.

FIGS. 18-1A, 18-1B, and 18-1C are illustrated as approximately 50% full of molten material.

FIG. 18-2A, is a perspective view of a storage container for molten matter from an industrial facility shown in FIG. 1, FIG. 18-2B is a perspective view of an example rectangular prismatic container, and FIG. 18-2C is a perspective view of the container illustrated in FIG. 2.

DETAILED DESCRIPTION

Figure 1:
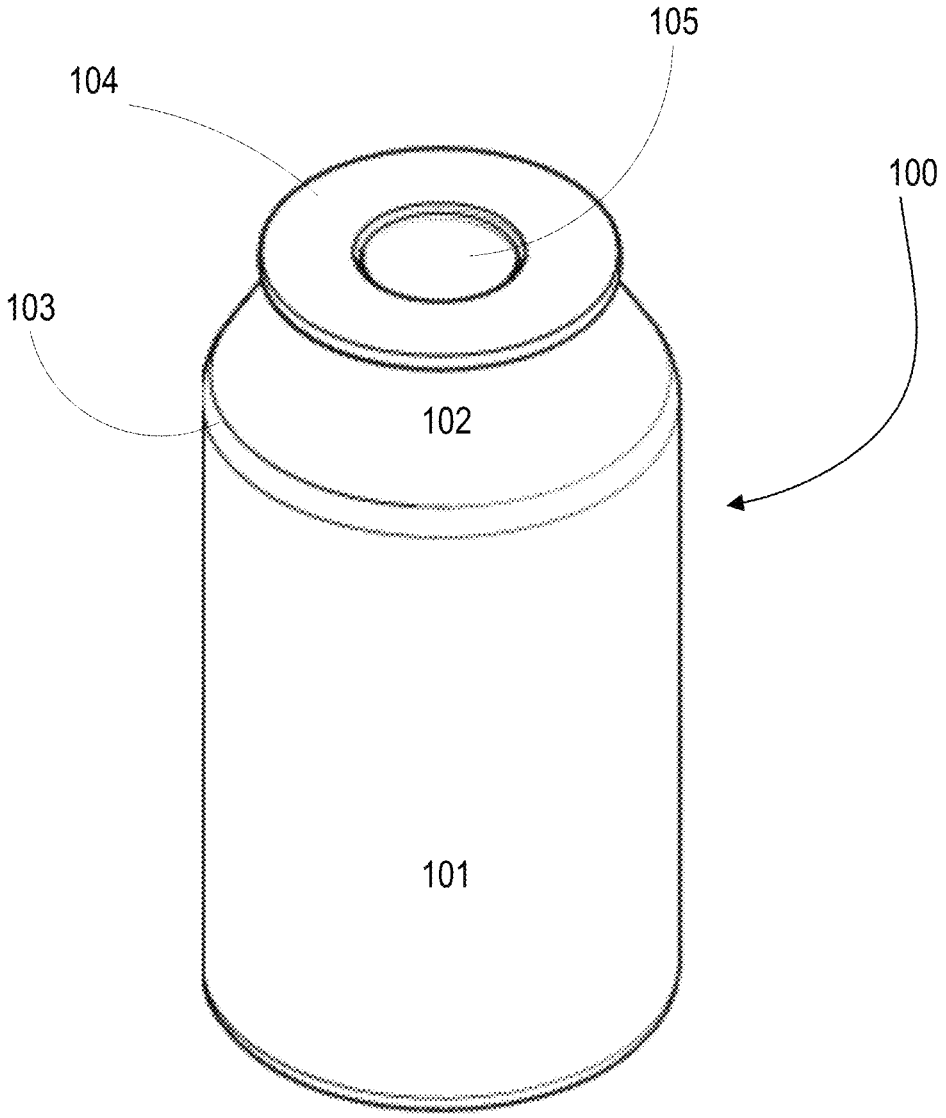
FIG. 1 is a perspective view of a storage container for molten matter from an industrial facility.

FIG. 1 illustrates a container 100 for storage of material from an industrial facility. The container has a cylindrical body 101 connected to a head 102 at a shoulder 103. A circular flange 104 defining an aperture 105 is connected to the head for loading the container with molten material such as, for example, molten glass. The cylindrical shape of body 101 avoids creating stress points at seams that may fail when exposed to high temperature material. However, when filled with molten material, container 100 is stored adjacent and abuts other containers. Because the cross-section of container 100 is circular, potential storage volume is lost between cylindrical container 100 and adjacent containers as neighbouring containers cannot immediately abut container 100 around its entire circumference.

In contrast, containers with square cross-sections are able to abut similarly shaped containers about their perimeter and thus maximize overall storage volume of a facility storing waste or other material (e.g., molten glass) in square cross-sectioned containers. However, the intersections of the sides of a square cross-sectioned container create seams that may act as stress points. Minimizing stress points is important to avoid distorting the container and loss of containment.

A square cross-sectioned container will increase the volume held by the container in comparison to a cylindrical container of the same diameter. In an example, changing a cylindrical container with a diameter to a generally rectangular prismatic container having a length and width equal to the diameter of the cylindrical container will increase the volume held by the container by approximately 20%. While the fabrication cost for generally square cross-sectioned containers may be slightly higher than cylindrical containers, increased volume minimizes the overall number of containers required to store material.

Figure 2:
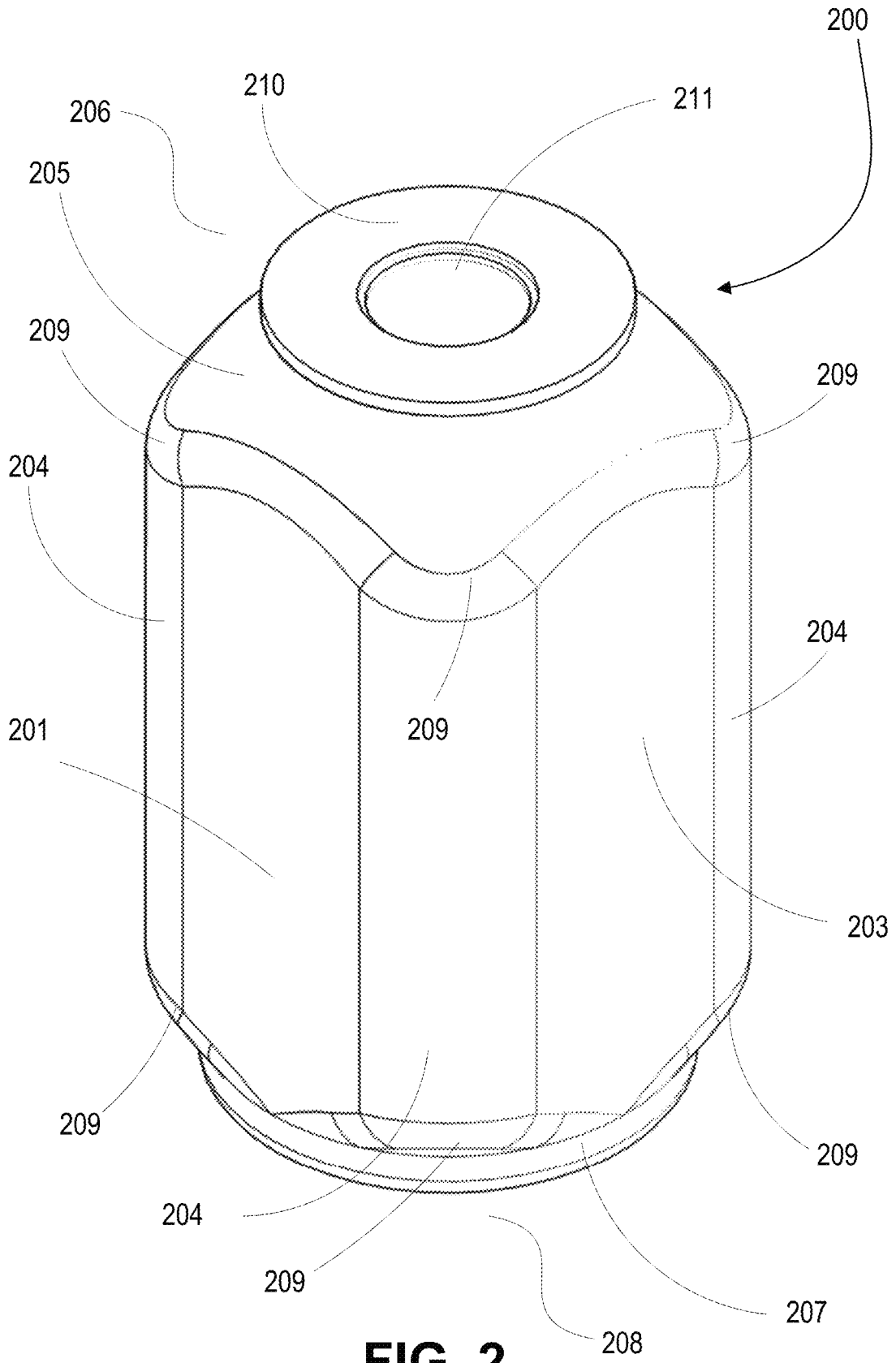
FIG. 2 is a perspective view of a container according to an embodiment of the present disclosure.
Figure 3:
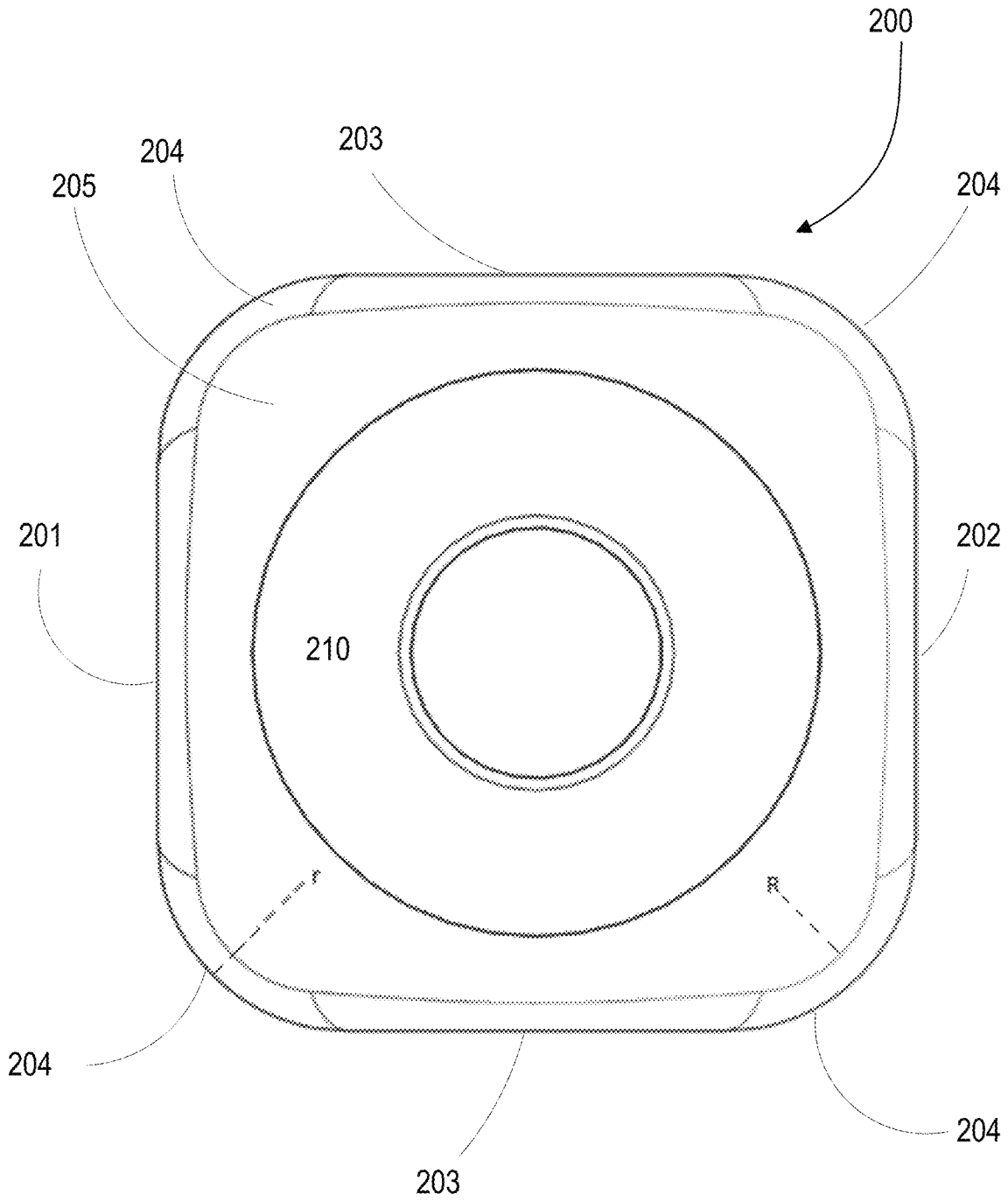
FIG. 3 is a top view of the container of FIG. 2.

FIG. 2 illustrates a container 200 for storage of molten material according to an embodiment of the present disclosure. Container 200 comprises a first wall 201 opposing a second wall 202 (shown in FIG. 3) and sidewalls 203 joining the first wall 201 and the second wall 202 at rounded convex-shaped edges 204.

First wall 201, second wall 202, sidewalls 203, and rounded, convex-shaped edges 204 of container 200 are shaped to prevent distortion (e.g., bowing outward) when container 200 is filled with high temperature material, such as, for example, molten glass. Further, the shape of walls, 201, 202, 203, and edges 204 resists forces that would cause distortion of the container by bowing inward. For example, the volume of high temperature material (e.g. molten glass), and the vapour pressure above the material, will decrease as both the material and the vapour cools. In a sealed container, a decrease in volume of the material and/or vapour pressure can reduce pressure (e.g., create a vacuum) within the container that may distort the container or cause loss of containment. The structural design of container 200 mitigates the potential for distortion. In an embodiment, the first wall 201, second wall 202, and sidewalls 203 define a generally square cross-section (e.g., in a horizontal plane when the second end 208 of container 200 faces downward). In another embodiment, walls 201, 202, 203 may have a short flat section with larger radius edges 204. In another embodiment, walls 201, 202, 203 may be concave and join the convex vertical edges 204 or convex and join the convex vertical edges 204. Each of the walls and edges of the container may have a uniform thickness.

Rounded convex-shaped edges 204 of container 200 provide strength to resist forces that might otherwise distort the container when the container is exposed to high temperature material such as molten glass, without undesirably reducing container internal volume. Convex shaped edges 204 are also more efficient than square edges in carrying loads associated with supporting additional materials placed on top of container 200, will help to distribute impact loads (e.g., if the container is dropped), and will help resist container breaching. Additionally, rounded edges allow the container to be constructed using thinner sheet metal, which reduces the weight and cost of the container. In an embodiment, the radius of curvature of the vertical edges may be varied to optimize the design for performance and fabricating costs.

As illustrated in FIGS. 2, 6, 9, and 13, container 200 has a first head 205 connected to the first wall 201, second wall 202, and sidewalls 203 at a first end 206 of container 200. The first head 205 is shaped as a tapered shoulder to smoothly transition from the first flange 210 to the junctions of the first wall 201 and second wall 202 with the sidewalls 203. The shape of the top head 205 of container 200 allows for container 200 to be generally rectangular prismatic, affording more internal volume than the cylindrical storage container shown in FIG. 1, while having a non-square cross-section at the first end (e.g., a round cross-section on the top, as shown in FIGS. 2-3, 6, 9, 10, 12). In another embodiment, the first head may taper toward a square cross-section at the first end (e.g., on the top). A smooth transition along the tapered shoulder is used in the first head 205 to minimize stress concentrations and thus allow for the use of thinner metal in the container's construction (e.g., reducing container weight and cost).

A second head 207 closes container 200 at the second end 208. The second head 207 is connected to the first wall 201, second wall 202, and sidewalls 203 at a second end 208 of container 200. Corners 209 are defined at the intersections of the first wall 201 and second wall 202 with the sidewalls 203 toward the first end 206 and the second end 208.

Corners 209 near first end 206 and second end 208 may be rounded to strengthen the container to resist forces that would otherwise distort the container when exposed to high temperature material (e.g., molten glass), without undesirably reducing container internal volume. In addition, rounded corners 209 resist stresses associated with lifting the container while still at elevated temperature from receiving hot material. Rounded corners 209 also distribute impact loads from dropping of the filled container and resist container breaching. Rounded corners 209 can allow for the construction of container 200 using thinner sheet metal and thus reduce the container's weight and cost. In an embodiment (e.g., FIG. 3), the radius Rof corners 209 and the radius r of the vertical edges may be varied to optimize the design for performance and fabricating costs.

In some embodiments, the container is configured/shaped to allow machinery to couple with and/or move container 200. For example, in some embodiments, a first flange 210 is connected to the first head 205. First flange 210 defines an aperture 211, which communicates with the internal volume defined by container 200. As illustrated in FIGS. 2, 3, 6, 9, 10, and 13, the first flange 210 may be circular; however, the shape of the flange may be any suitable shape (e.g., square-shaped) for coupling with machinery for transportation and/or for receiving molten material. First flange 210 may be configured to couple with a grapple of a crane to permit the crane to position container 200 at a desired location. In an example, first flange 210 may have a lip 211 configured to couple with a grapple of a crane. Support member(s), e.g. lifting lugs (not shown), may also form part of an external surface of container 200 for moving container 200 to a desired location by a crane or other lifting machinery. In an embodiment, the first flange 210 may have an outside diameter of 36 inches (in) (91.44 centimeters (cm)) and an inside diameter of 16 in (40.64 cm). Other diameter sizes for the first flange are possible.

When in use, a container according to the present disclosure may be placed (e.g. by a crane) into a lifting container and positioned under a discharge location of a melter. The container 200 may be raised to the melter by a lifting mechanism. The second head 207 of container 200 may be configured to couple with a corresponding recess in the lifting mechanism, and/or lifting container, such that container 200 may be secured during transport or when being filled with molten material. In another embodiment, container 200 may be rolled into position, or moved by other means of transport. First flange 210 may be configured to interface with the melter, e.g. at a counterpart flange of the melter, and in some embodiments a locking mechanism of the melter may releasably couple to lip 211.

Figure 5:
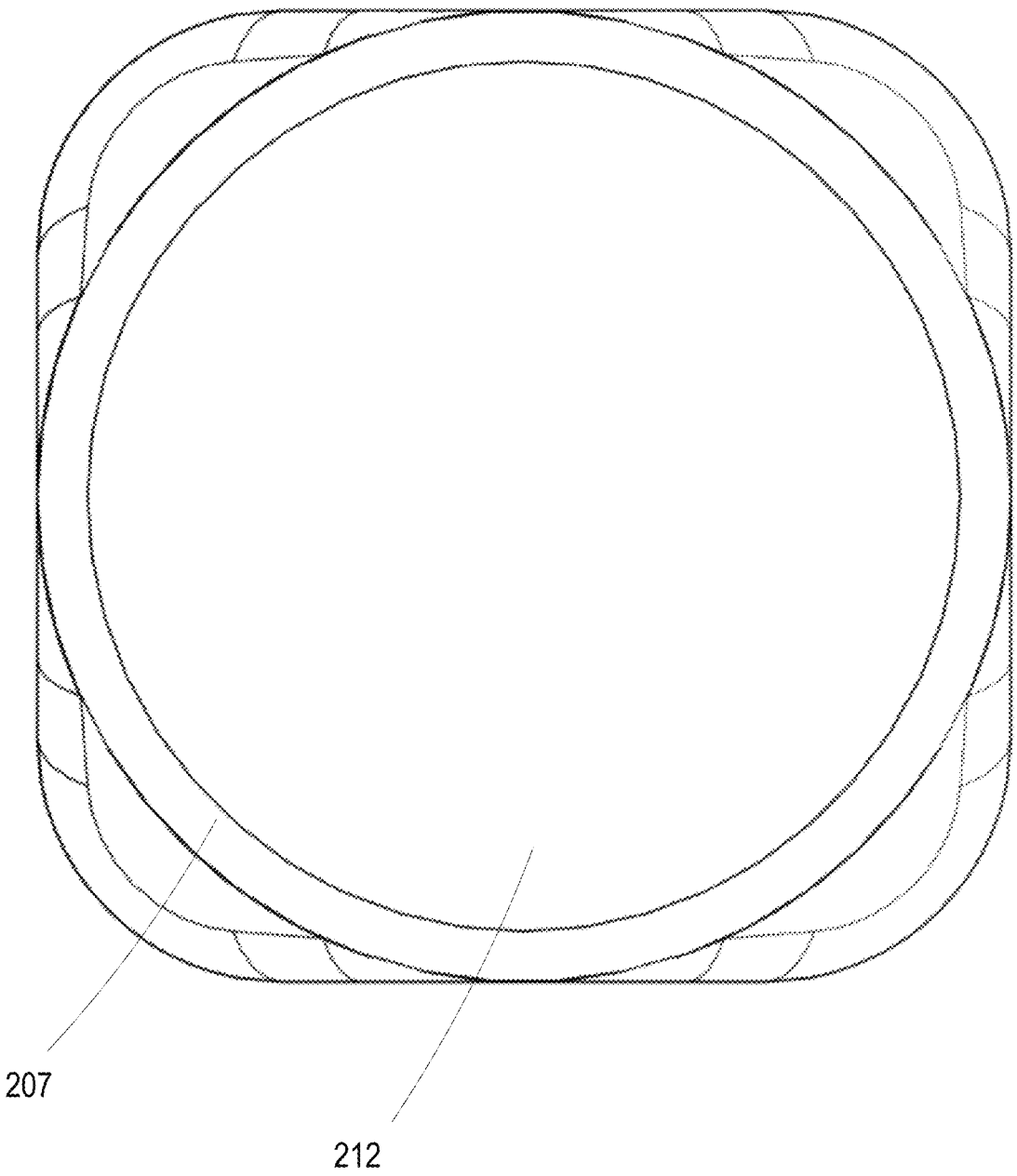
FIG. 5 is a bottom view of the container of FIG. 2.
Figure 6:
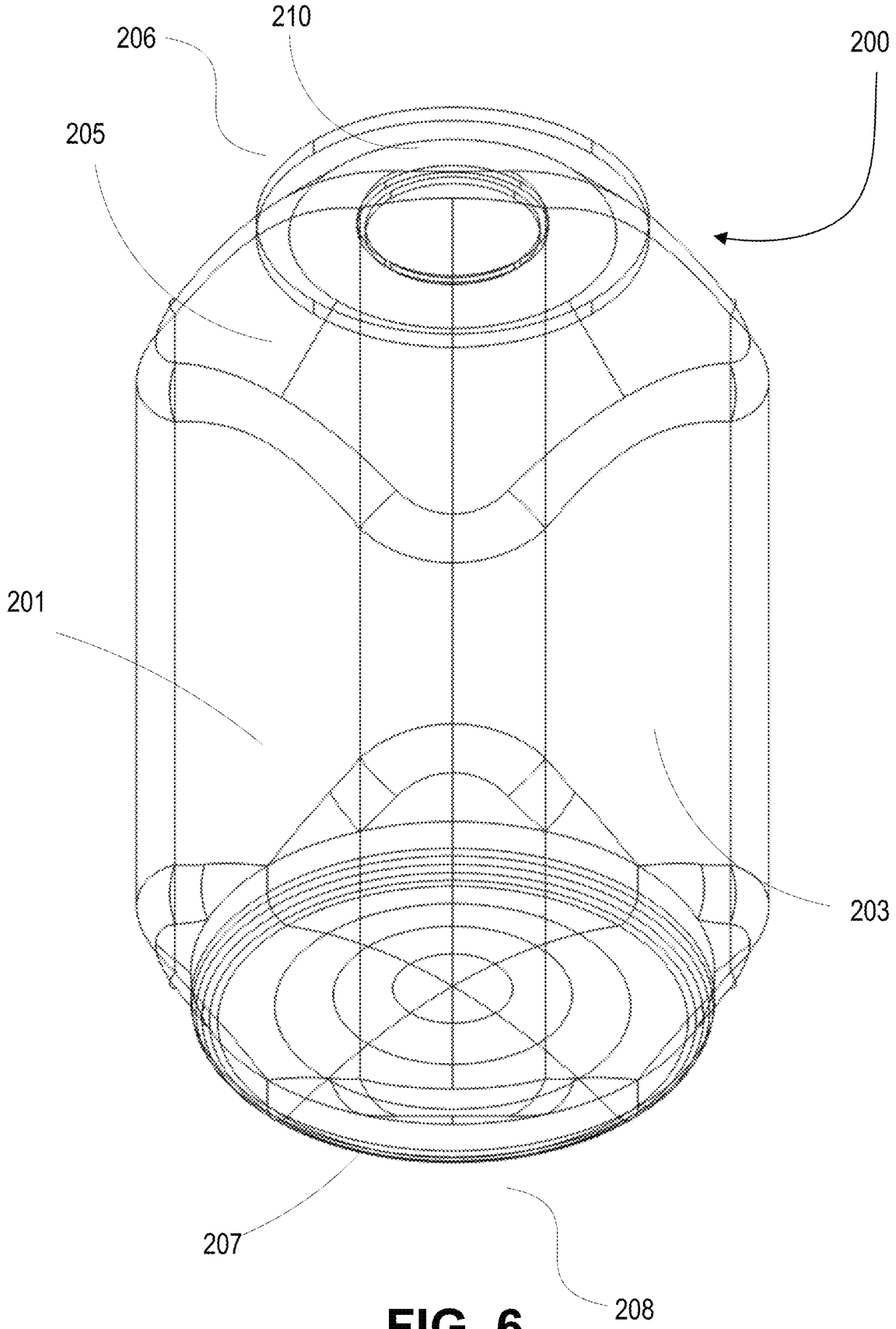
FIG. 6 is a perspective view of a container according to another embodiment of the present disclosure.
Figure 7:
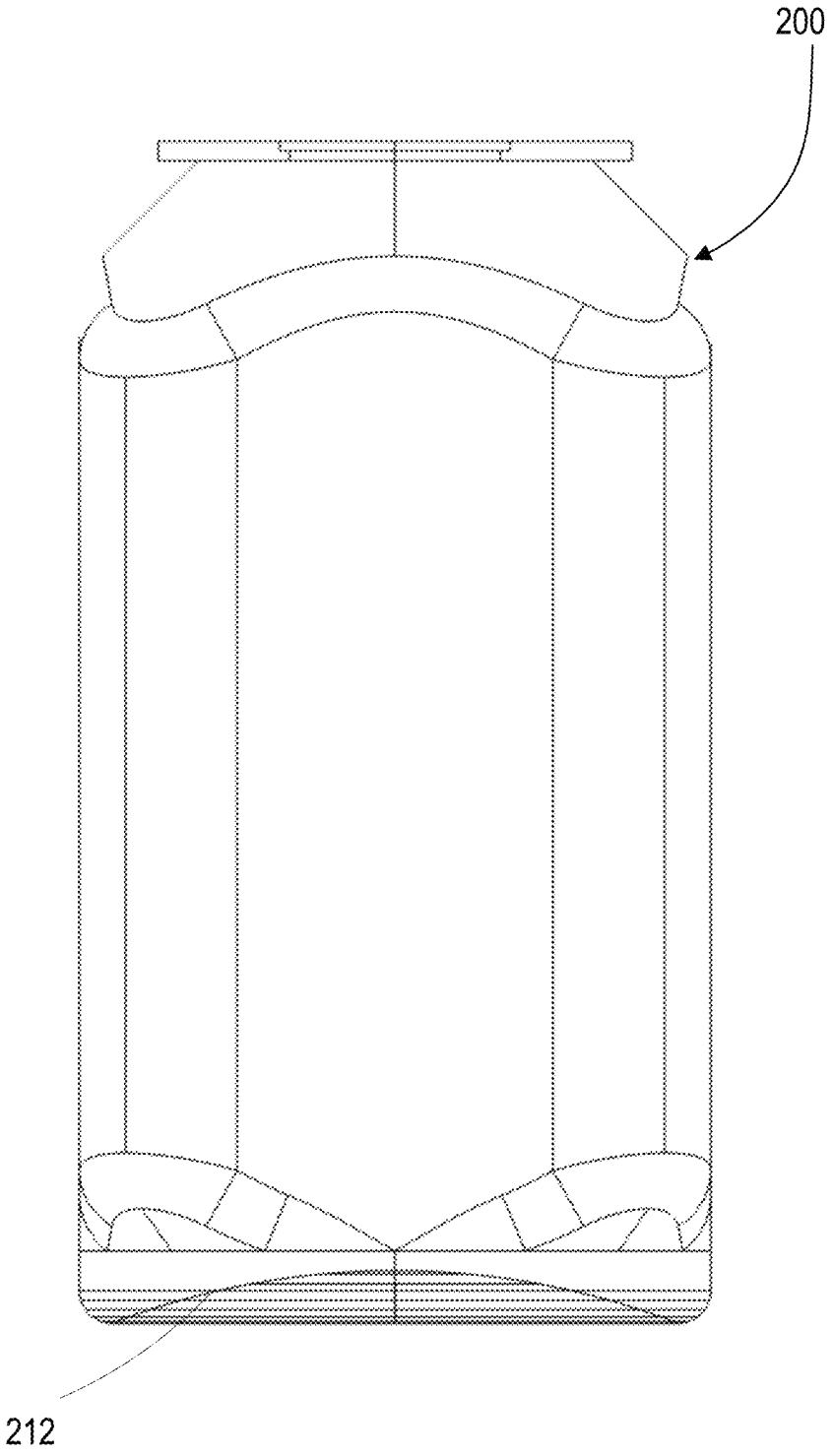
FIG. 7 is a side view of the container of FIG. 6.
Figure 8:
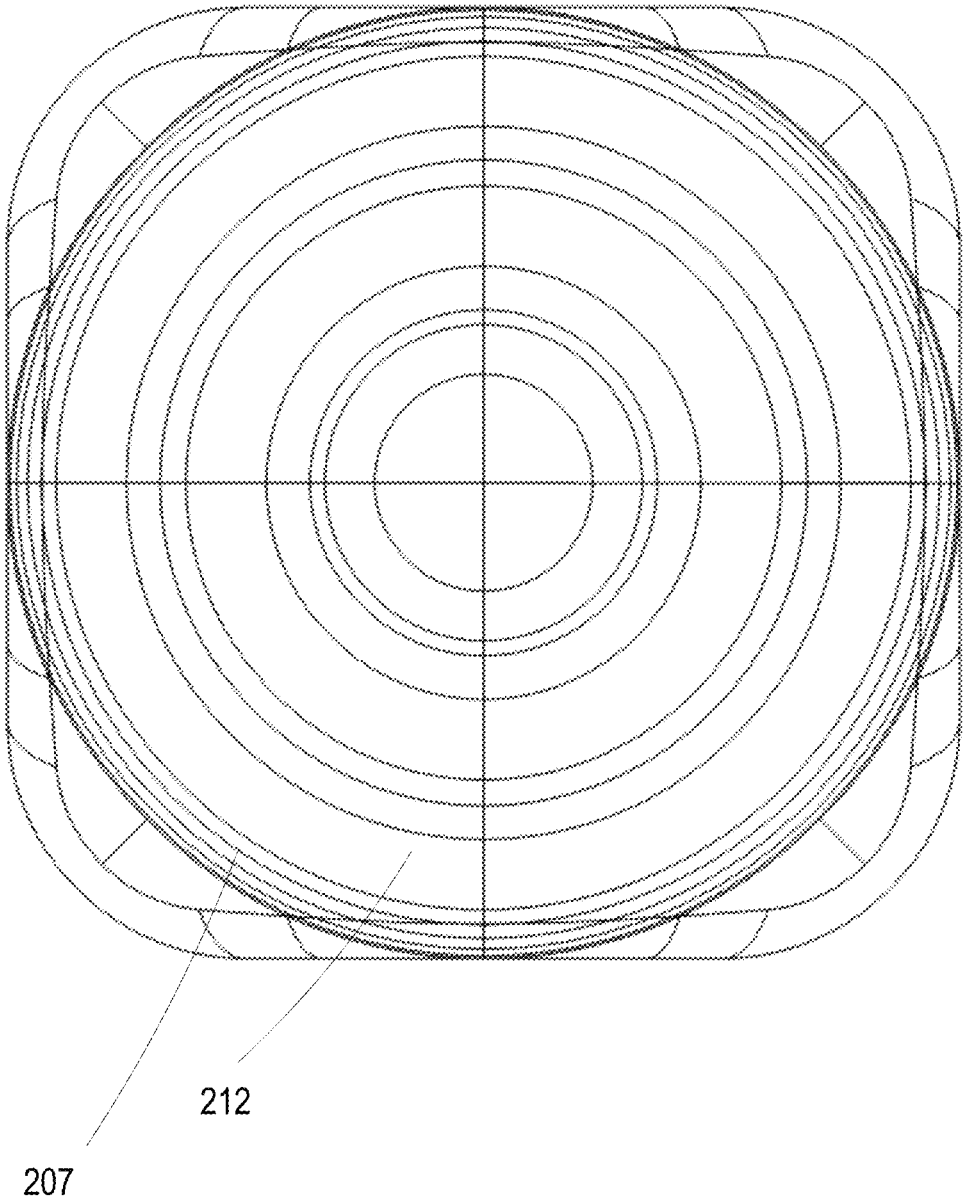
FIG. 8 is a bottom view of the container of FIG. 6.
Figure 9:
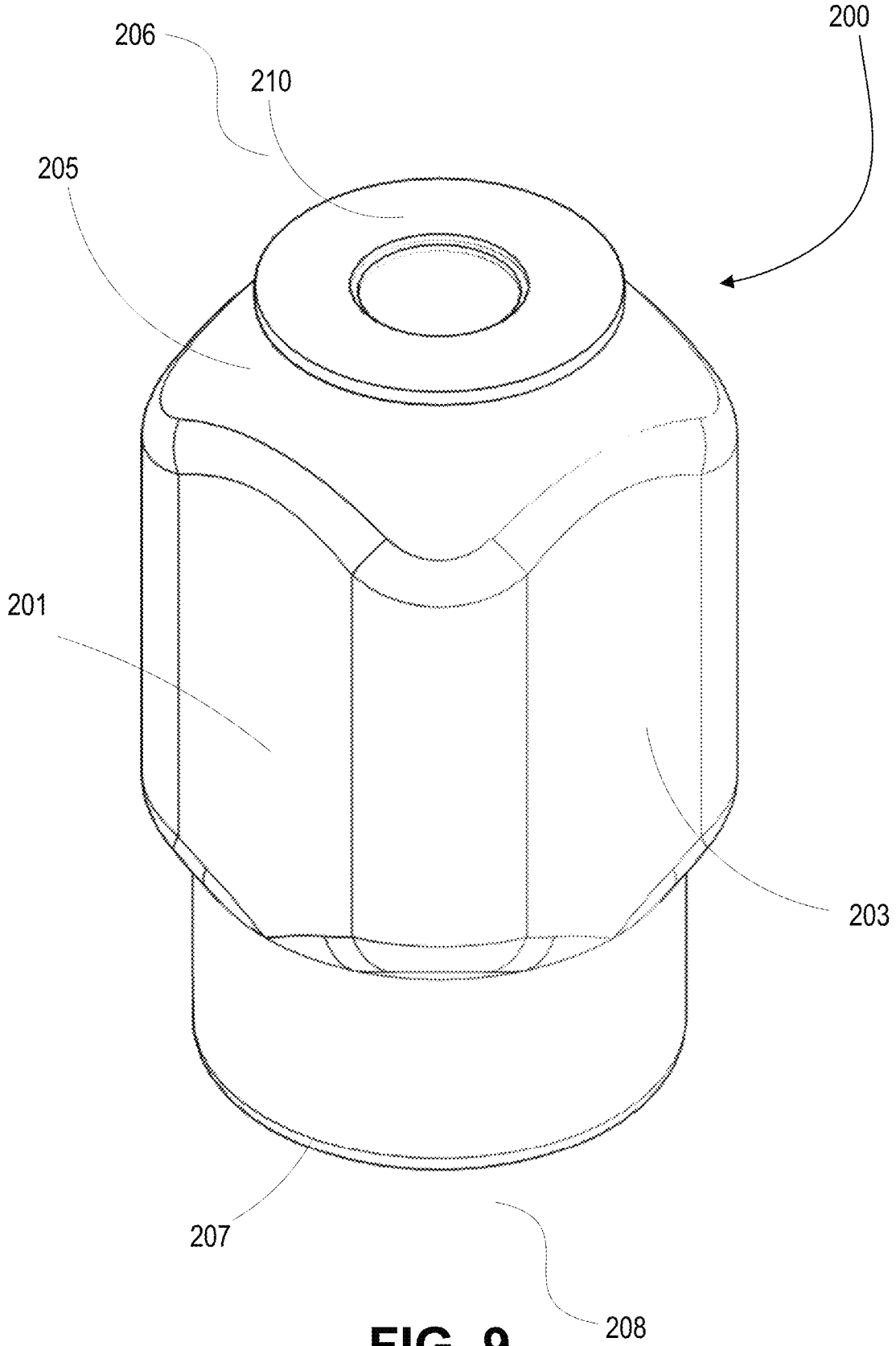
FIG. 9 is a perspective view of a container according to another embodiment of the present disclosure.
Figure 10:
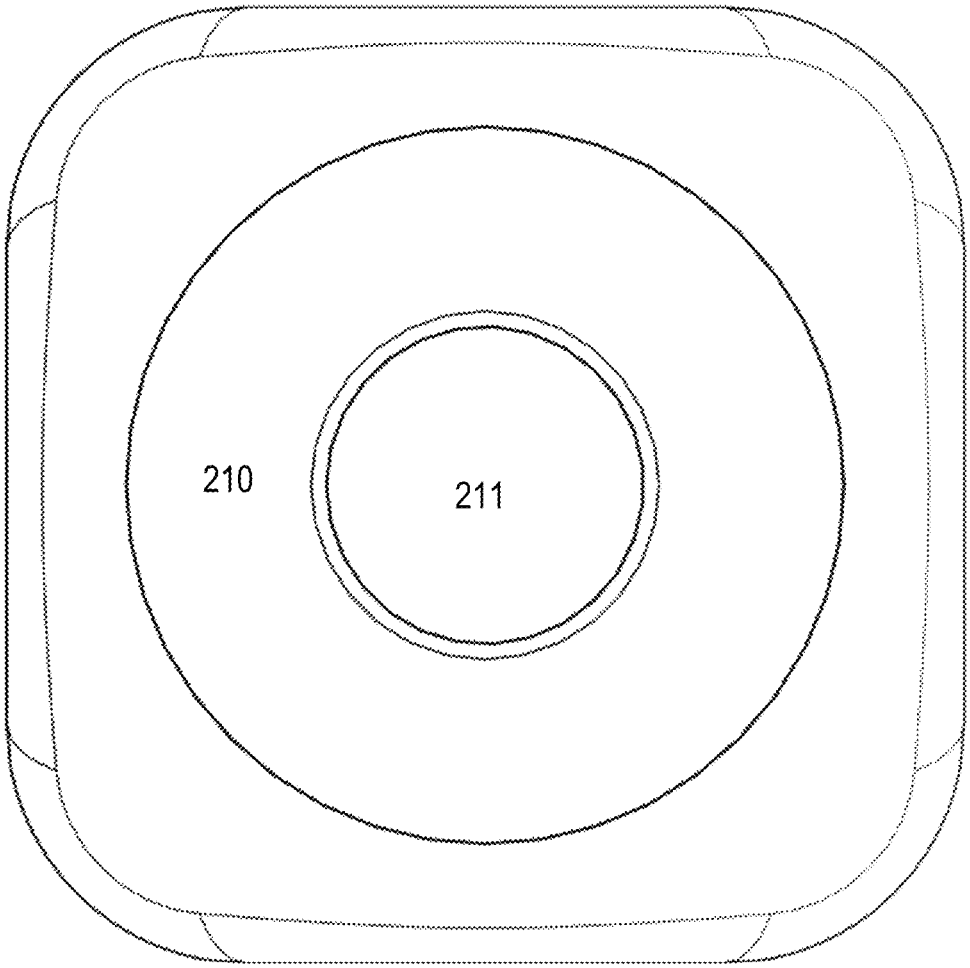
FIG. 10 is a top view of the container of FIG. 9.
Figure 12:
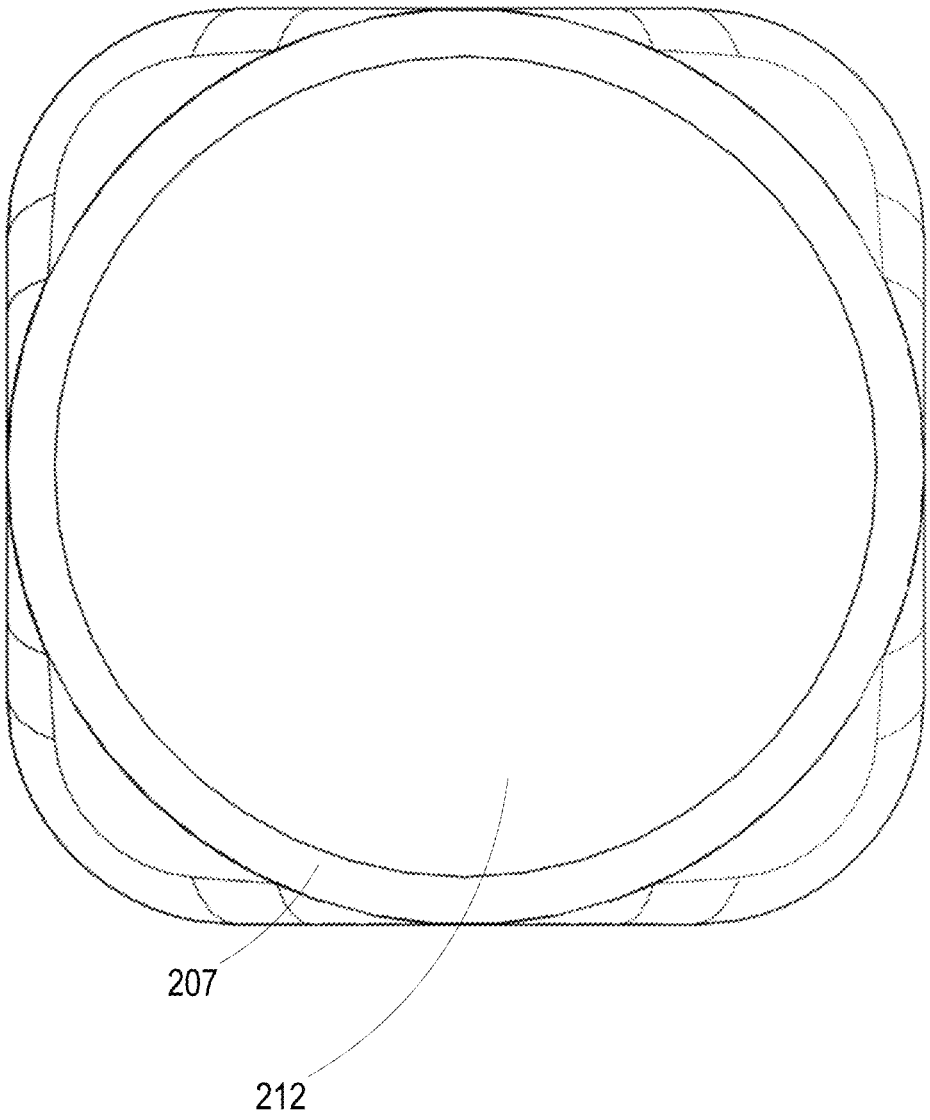
FIG. 12 is a bottom view of the container of FIG. 9.
Figure 13:
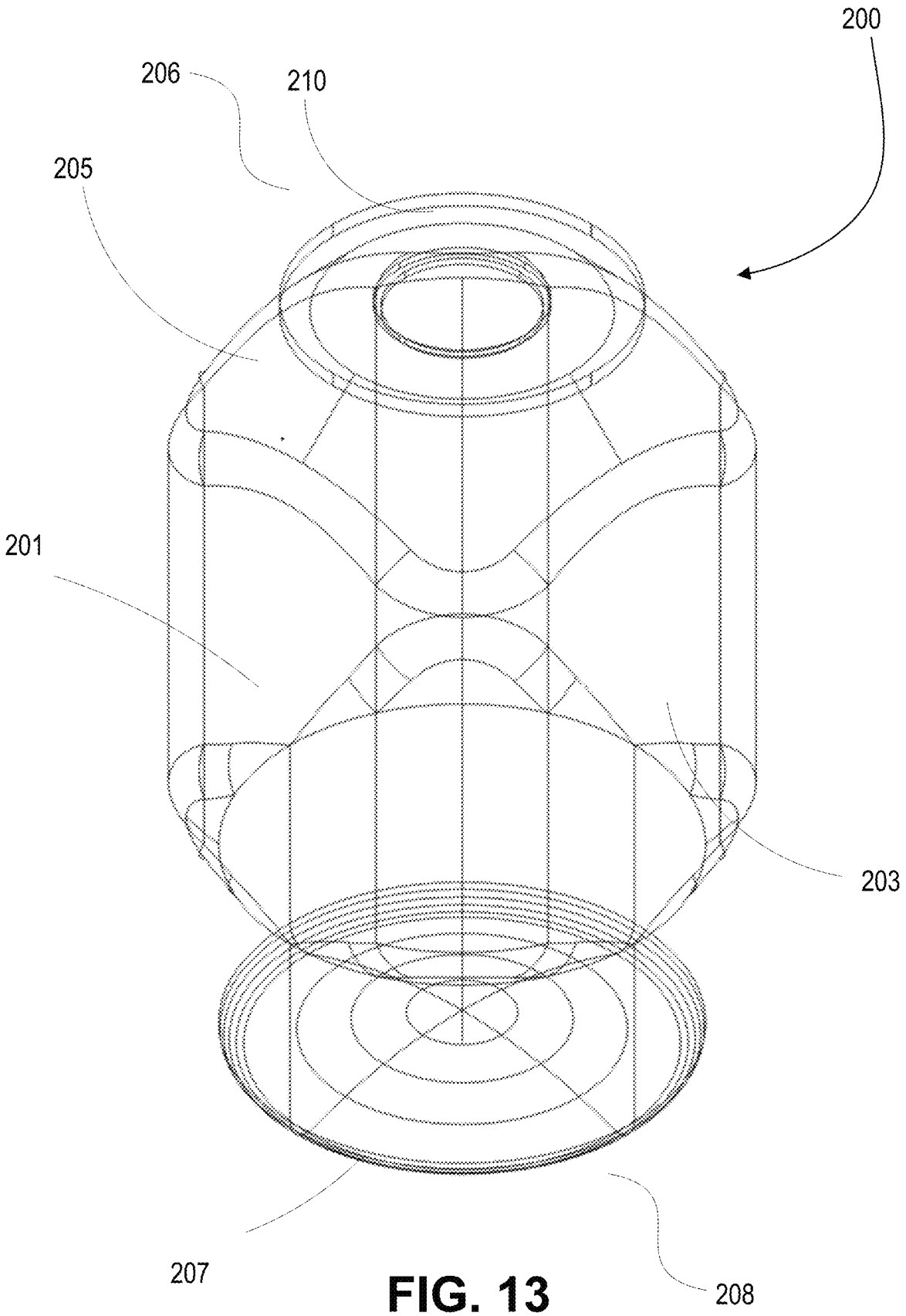
FIG. 13 is a perspective view of a container according to another embodiment of the present disclosure.
Figure 14:
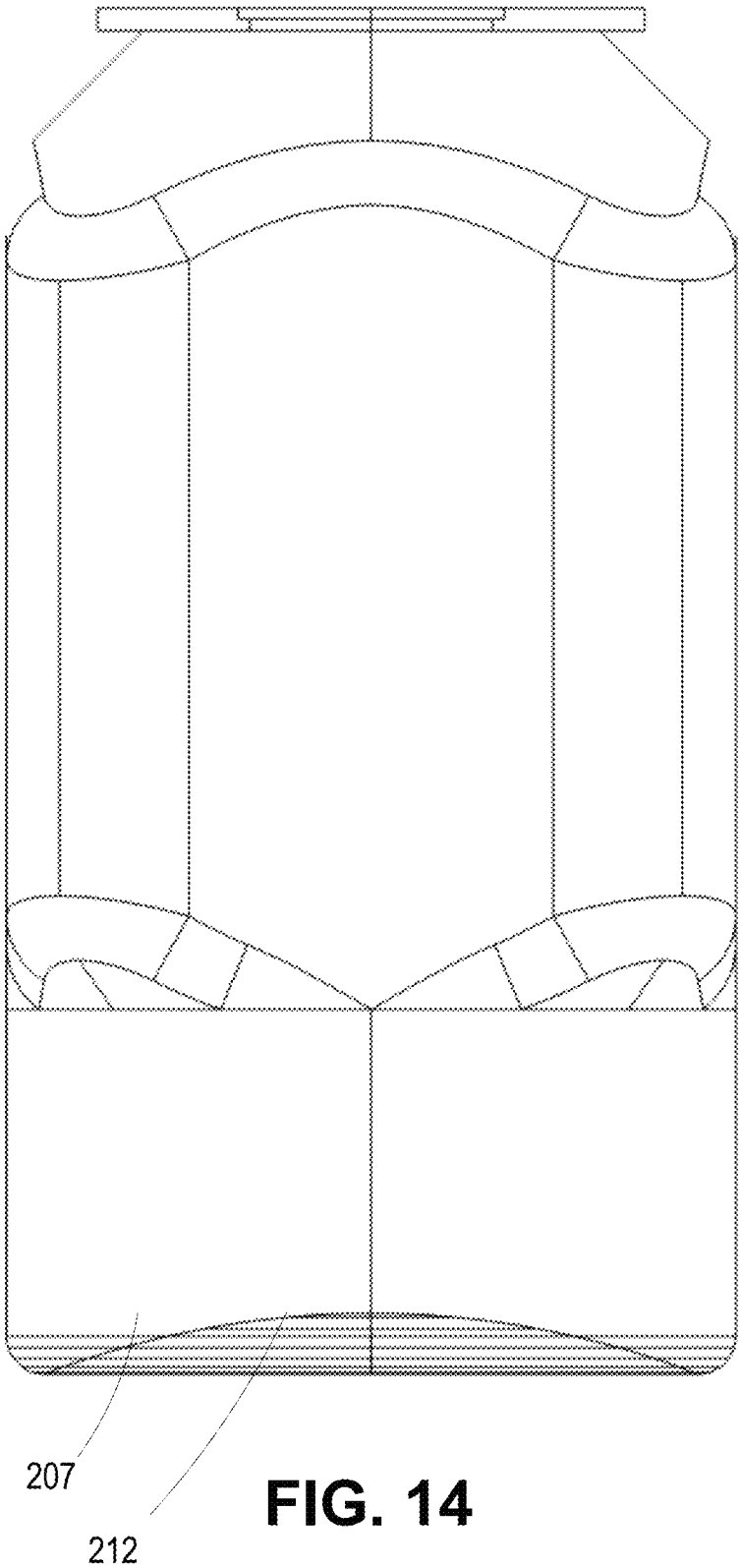
FIG. 14 is a side view of the container of FIG. 13.
Figure 15:
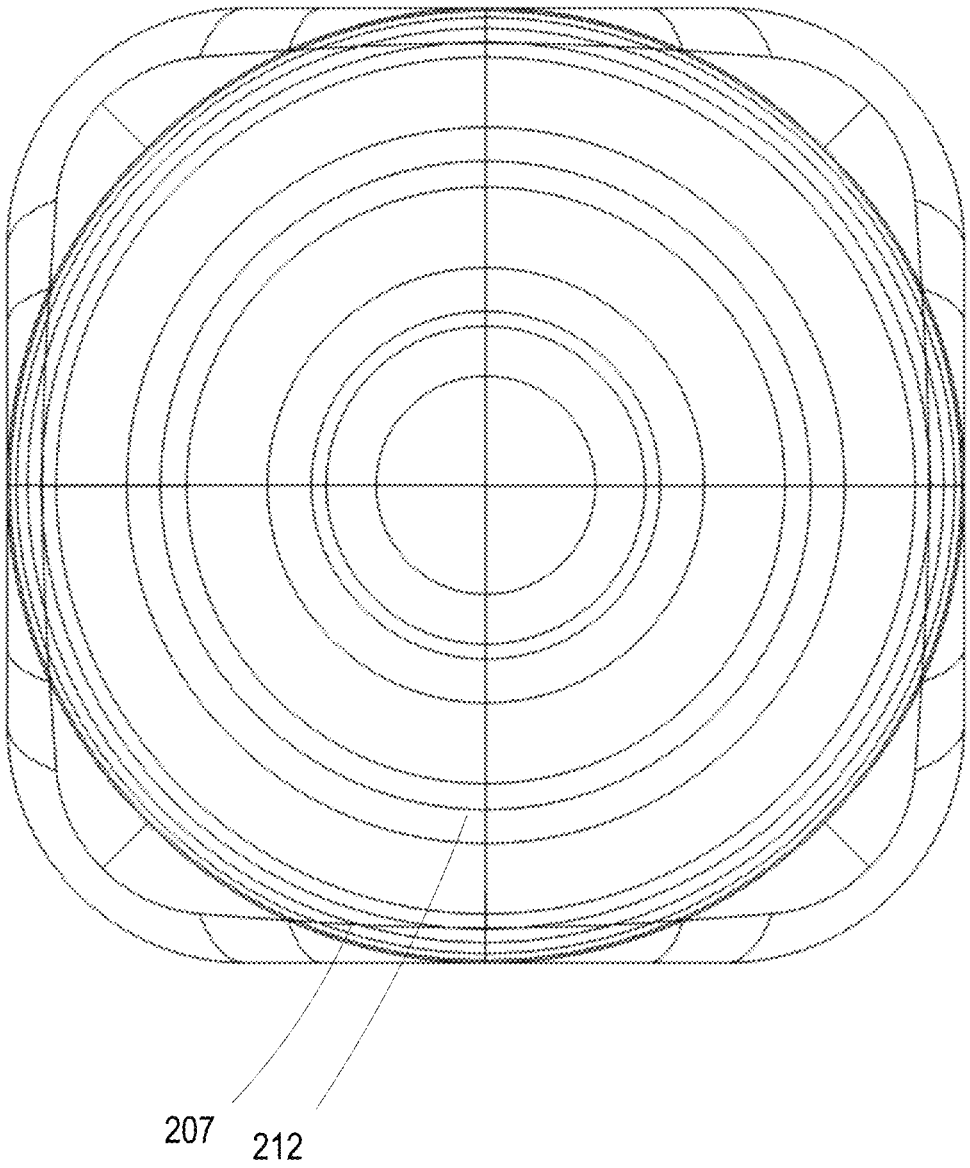
FIG. 15 is a bottom view of the container of FIG. 13.

As illustrated in FIGS. 2, 5, 8, 12, and 15 the second head 207 has a circular cross-section. In other embodiments the shape of the second head may vary and may be so as to interface with machinery to move and secure container 200. A surface 212 of second head 207 closest to second end 208 may be flat as shown in FIGS. 5 and 12, or concave as shown in FIGS. 7, 8, 14, and 15. Similar to walls 201, 202, and 203, surface 212 may be concave-shaped to prevent distortion when container 200 is filled will molten material. A concave bottom surface also urges molten material introduced into container 200 toward the perimeter of the bottom surface to mitigate void formation (e.g., gas pockets forming inside container 200 near second end 208).

Figure 4:
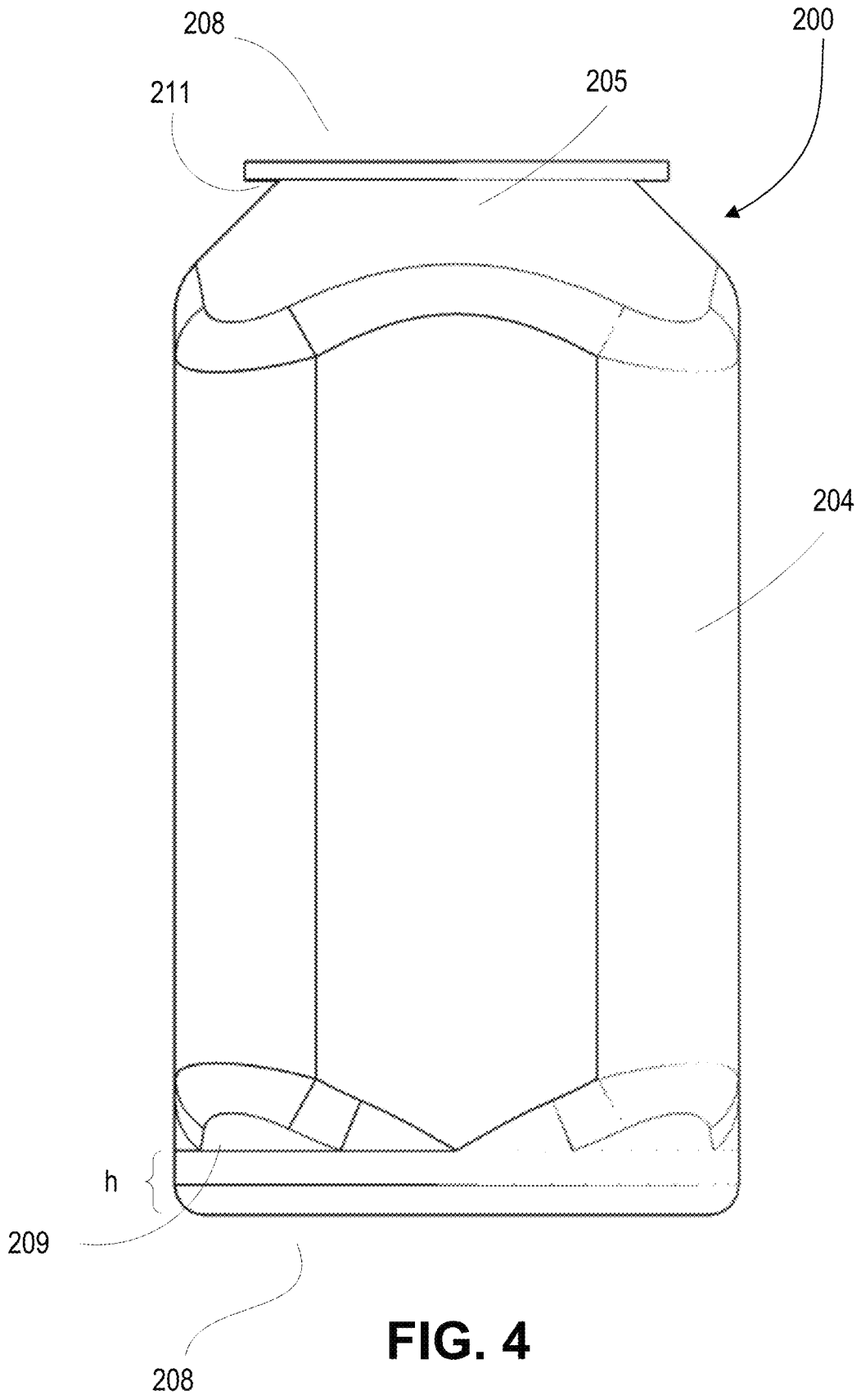
FIG. 4 is a side view of the container of FIG. 2.
Figure 11:
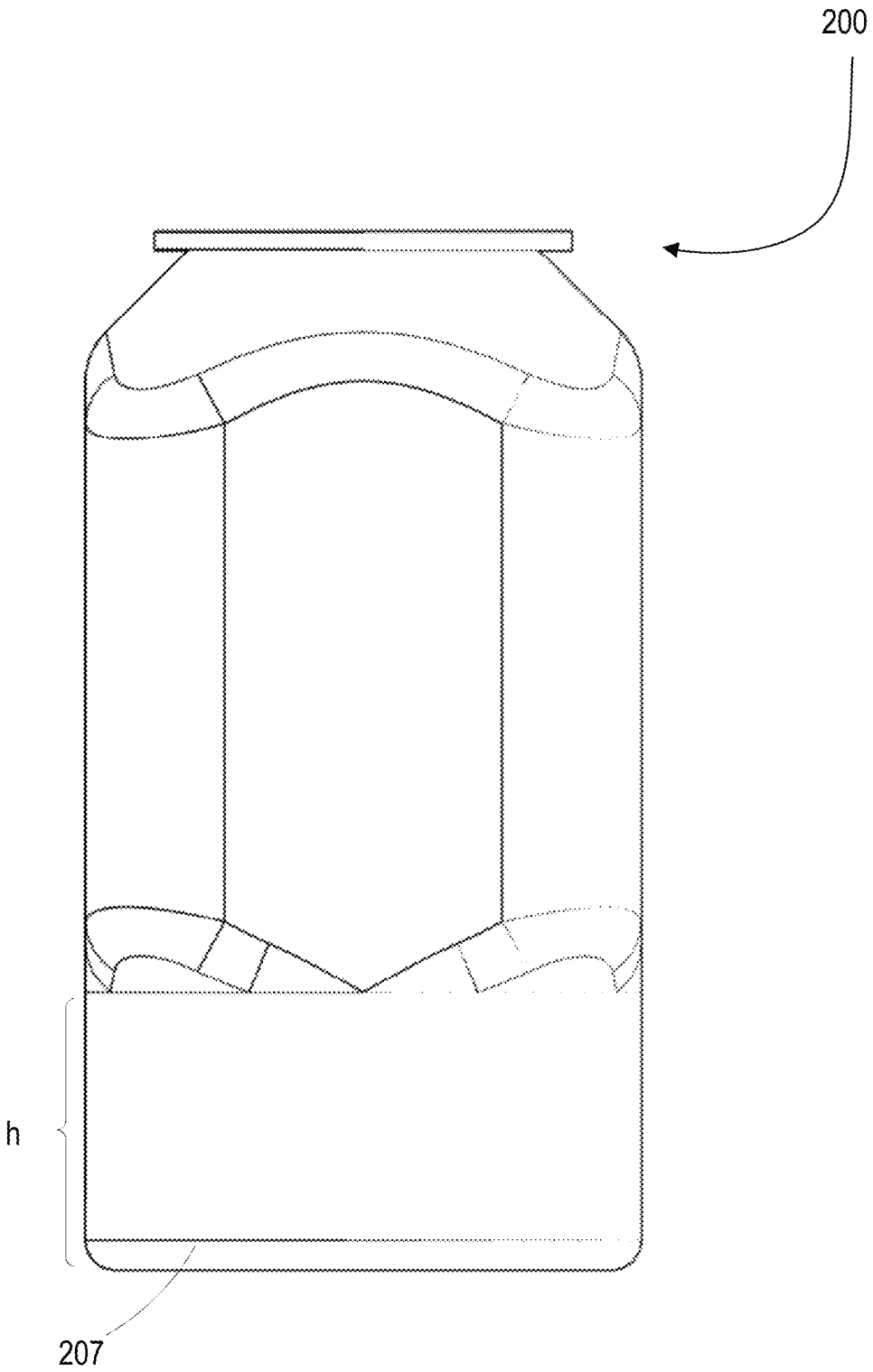
FIG. 11 is a side view of the container of FIG. 9.

As illustrated in the embodiment shown in FIGS. 4 and 11, the height h of the second head 207 may extend along a longitudinal axis of the container parallel to the walls 201, 202, 203 to interface with existing plant equipment. Internal volume of the container 200 may be maximized by minimizing height h of second head 207

In an embodiment, a second flange may be connected to the second head 208 to allow container 200 to interface with machinery to move and secure container 200. Second head 208 may have a circular cross section when viewed along the longitudinal axis of container 200.

In some embodiments, the container 200 may be for receiving a matrix of glass and one or more other materials. For example, nuclear by-products or other material may be vitrified in a glass matrix. This matrix may immobilize radioactive material for storage during a decaying period.

Container 200 preferably does not have internal structures in order to maximize its internal volume and minimize fabrication costs. Container 200 being free of internal structures also mitigates problems when filling the container, such as those related to the molten material (e.g., glass) cooling, void formation, and thermal stresses that such internal structures might experience.

Various materials are suitable to make a container according to the present disclosure. For example, the container may be fabricated from 304 L stainless steel, a lesser-grade stainless steel, or a simple low-alloy steel.

As described herein or otherwise, in some embodiments, the container is structured, shaped and/or dimensioned based on or as a function of a pour/flow rate of the molten material to be stored in the container, the viscosity of the molten material, the temperature of the molten material, the heat capacity of the molten material, and/or a combination thereof.

Figure 19:
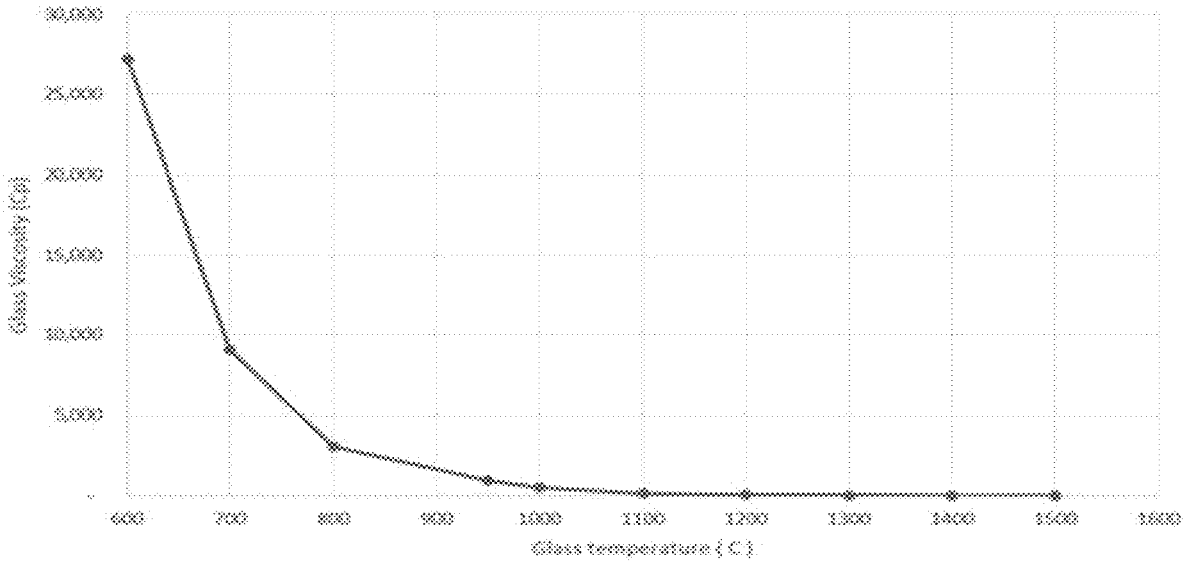
FIG. 19 is a chart correlating molten glass viscosity to temperature.

Molten material pour rate (i.e. the rate at which molten material is poured into a container through an aperture in the first flange) may also be a consideration in the design of a container for receiving high temperature molten products. Molten glass has a high heat capacity and contains a significant amount of energy that, after pouring into a container, is lost to the surrounding environment primarily through radiation and convective heat transfer. The energy from the molten material, e.g. molten glass, may be absorbed by equipment or a surrounding structure proximate to a container containing the molten material thus raising the temperatures of the equipment/surrounding structure, which potentially could damage surrounding structures and equipment or increase costs associated with adding design features to counter act energy absorption. The rate of energy loss from a container containing molten material may be increased by increasing the glass pouring rate of the molten material, which in turn may impact the design and maintenance of a molten material facility to prevent equipment damage. However, while higher pour rates of molten material may be problematic due to strain and stress applied to the container in which the material is poured, and to the equipment/structures proximate to the container, if the pour rate is too slow pockets of unfilled space may appear within the container due to solidification of the glass prior to reaching the sidewall. As molten glass cools the properties of the flowing glass change. For example, viscosity of molten glass increases with reduced temperature as detailed in: NBS Special Publication 260-23, Standard Reference Materials, Viscosity of Standard Borosilicate glass, U.S. Department of Commerce, National Bureau of Standards, Washington DC, 1970, the contents of which are incorporated by reference herein. As such, minimizing the distance that molten material must flow within a container may reduce the required pour rate and potential formation of unfilled spaces within container after it has solidified. The rate of glass discharge determines the rate of heat addition to the container. As glass contact the bottom it begins to flow radially outward. As it flow, heat is lost through the container floor. As the glass cools, the viscosity increase dramatically as shown in FIG. 19.

Using molten glass as an example, as the molten glass viscosity increases, its radial flowrate will slow until the temperature drops below about 800° C. In order to fill the container, the glass flow rate must be high enough so the rate of heat addition from the glass overcomes the rate of heat loss to the environment surround the container such that the glass temperature remains above 800° C. when it reaches to container wall. The rate of heat loss from the molten material is related to the surface area of the container. For container with a shape other than cylindrical containers having a round cross section, the distance that the glass must flow to reach the further wall will be greater (e.g. for containers that have a square or generally square cross section) as discussed below in Examples 1-3.

Molten glass temperature will decrease dramatically the further it flows owing to head loss associated with spreading the molten glass over a growing area. Pouring glass at a higher rate will increase the mass of glass at any radial distance from the center providing more energy in the glass compared to the constant rate of heat loss which may lead to a higher retained glass temperature, lower viscosity and further distance the glass can flow.

In an example, 14000 pounds of molten glass transferred into a container resulting in a total of 1.7 mega-watt-hours of energy transferred with the molten glass into the container. After the molten glass enters the container, it travels a distance to one of the walls of the container. The distance from the point of entering the container to the furthest wall is the "flow path length". In some examples, the flow path length is measured in a horizontal plane such as when the container is initially filled (e.g. if the bottom head is flat). As the container fills, molten material may mound and the flow path length may be angled or curved with respect to the horizontal plane. Because the distance between the center of the container and furthest wall of the container (based on a cross sectional view of the container viewed from above), i.e. the flow path length, may be greater for containers having a generally square cross-section ("square container") in comparison to cylindrical containers—as such, the required pour rate for a square container may be up to 30% higher than a cylindrical container having round cross-section. Square containers may also have a relatively larger surface area than a similarly sized cylindrical container leading to a higher energy loss rate and more extensive heating of surrounding equipment.

The container described herein may have a generally rectangular prismatic shape having a generally square cross sectional profile (with rounded edges) when view from above. As illustrated in FIGS. 2-15, walls 201, 202, 203 may be concave and join convex vertical edges 204, which may achieve a reduced flow path length in comparison to square containers. Concave walls 201, 202, 203, and/or convex vertical edges 204 may also increase volume to surface area ratio of a container which may reduce energy transfer rate per unit volume of molten material from the container resulting in a reduction of stress, strain, and deformation of the container, and in heating of surrounding equipment in comparison to both cylindrical or square containers. Additionally, increasing the volume to surface area ratio of the container may reduce expenditures on containers since fewer are required for a fixed volume of molten material production. Maximizing volume to surface area ratio of a container within set packing volume may permit the maximum packing volume while minimizing the rate of heat loss from the container which may cause damage to the container or external components. In an embodiment, configuring the radius of curvature of the vertical edge to maximize volume to surface area ratio may determine the flow path length (i.e. the initial flow path length of the empty container in some embodiments)—the farthest distance the molten material has to flow to reach the furthest container wall. A longer flow path length may result in greater energy loss than a shorter flow path length, potentially causing molten material to become more viscous which may result in voids forming is the solidified molten material. Pouring molten material into the container at an increased rate may reduce the potential for voids; however, increased molten material flows rates results in higher energy input/temperature of the container and surrounding equipment which causes stress, strain, and/or distortion of said container and surrounding equipment.

As molten glass is poured into a container with a horizontal bottom surface (e.g. a flanged or dished bottom surface), it will flow radially outward from the point of contact until it reaches the wall of the container. Molten material may be poured into a centermost point of the container to avoid creating an extended flow path length. As it flows, energy is lost from the glass to the container and surrounding environment though conductive, convective, and radiant heat transfer. This energy loss causes the temperature of the glass to decrease with a corresponding significant increase in glass viscosity. Therefore for any given glass composition, and corresponding viscosity rate of change, the distance that the molten glass can flow from the point of pouring is limited by the glass temperature. The temperature of the flowing glass can be increased by pouring at a faster rate such that the rate of heat loss, which is relatively constant, is overcome by the rate of energy added by the additional glass added to the container. This means that the size of any container, and the volume of glass it can contain, may be limited in part by the rate of glass pouring. The rate of pouring and cross-sectional area of a container may be limited by the ability of the glass to flow and effects such as heating of surrounding equipment as described above.

In an example, a test melter had a glass production rate of 10 kg/day (large scale production facilities may produce glass at rates up to 22,000 kg/day). The test melter discharged glass into a 6-in wide, 6-in long, 8-in deep metal square cross-sectional container. It was observed that if glass was not poured into the container at a sufficient rate, the glass would not flow to the corners. Further testing was then carried out on a pilot scale melter to determine if glass could flow to the perimeter of a 4-ft diameter cylindrical container. The testing indicated that the glass flow rate had to be sufficiently high to ensure the glass would reach the edge of the container due to cooling of the glass as it contacted the container which increased viscosity of the molten glass. Addition experimentation indicated that 4-foot square cross-sectional containers required higher flow rates to reach the corners of the container. An increased pour rate of approximately 30% required in comparison to the cylindrical container was attributed to the larger surface area, causing greater heat loss and increased viscosity—factors associated with a design having square corners and thus having a greater flow path length.

Figure 16A:
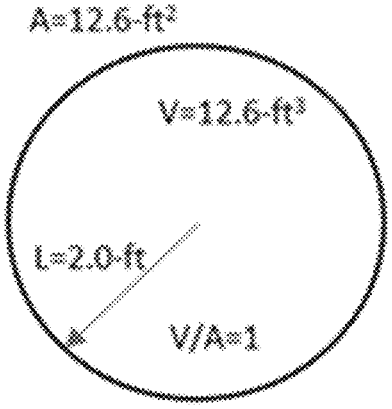
FIGS. 16A, 16B, and 16C are cross-sectional views of an example cylindrical container, and example square prism container, and a container according to an embodiment of the present disclosure.

Example 1. This example illustrates how surface area, volume, and flow path length may be calculated for a 1 ft section of an example 4-ft diameter container. Reference is made to FIG. 16A:

$$- A = H \times \pi \times D = 1 \times Pi \times 4 = 12.6\ \text{ft}^2$$

$$- V = H \times \pi \times \left(\frac{D}{2}\right)2 = 1 \times Pi \times (4/2)^2 = 12.6\ \text{ft}^3$$

$$- V/A \text{ ratio} = 12.6/12.6 = 1$$

$$- L = D/2 = 2\ \text{ft}$$

Definition: Surface area (A), Volume (V), V/A ratio, and maximum glass flow path length (L), wherein, Diameter (D) is 4 ft; and Height (H) is 1 ft.

Figure 16B:
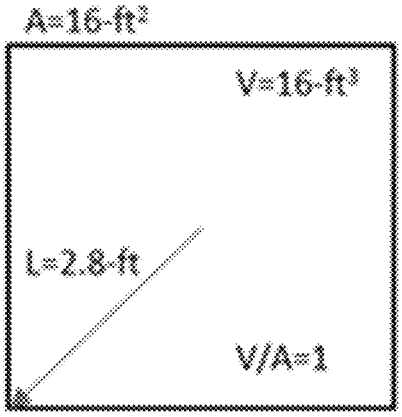

Example 2. In contrast to Example 1, a container with a square cross section (illustrated in FIG. 16B) may have an increased flow path length with the same volume to surface area ratio:

$$A=S\times\#\times H=4\times4\times1=16\ \text{ft}^2$$

$$V=S\times S\times H=4\times4\times1=16\ \text{ft}^3$$

$$V/A=16/16=1$$

$$L=((S/2)^2+(S/2)^2)^{1/2}=2.8\ \text{ft}$$

Definition: Surface area (A), Volume (V), maximum glass flow path length (L), wherein Length of Side (S) is 4 ft, Number of Sides (#) is 4; and Height (H) is 1 ft.

Figure 16C:
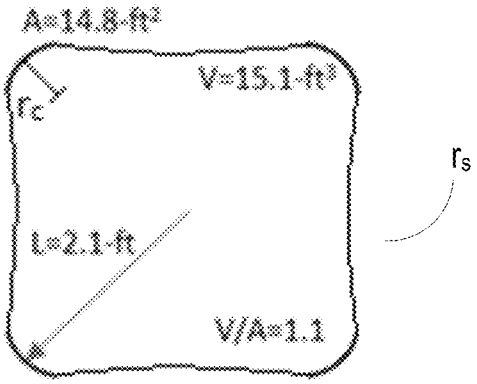
Figure 17:
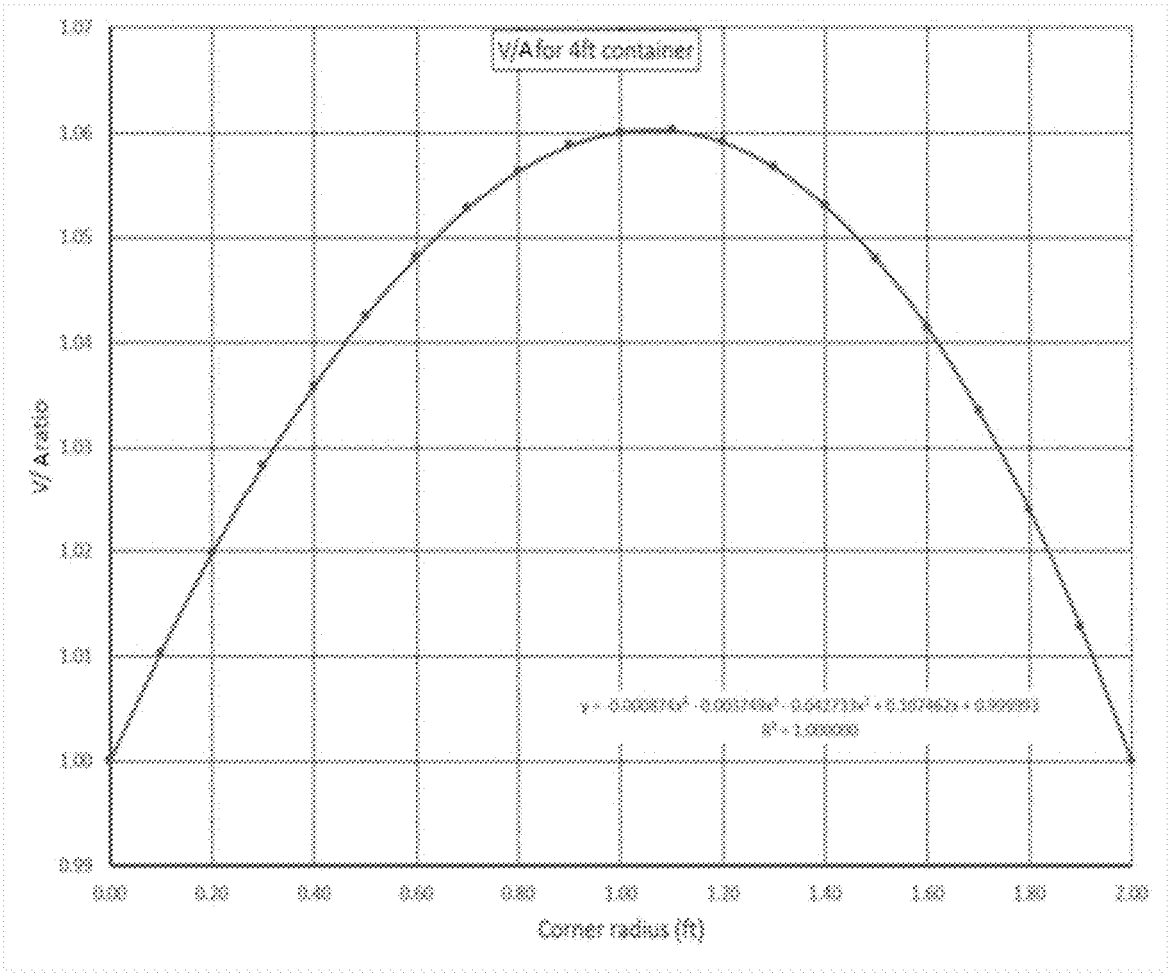
FIG. 17 is a chart correlating volume/surface area ratio to corner radius of an embodiment of the present disclosure.
Figures 1A, 1B, 1C, 18:
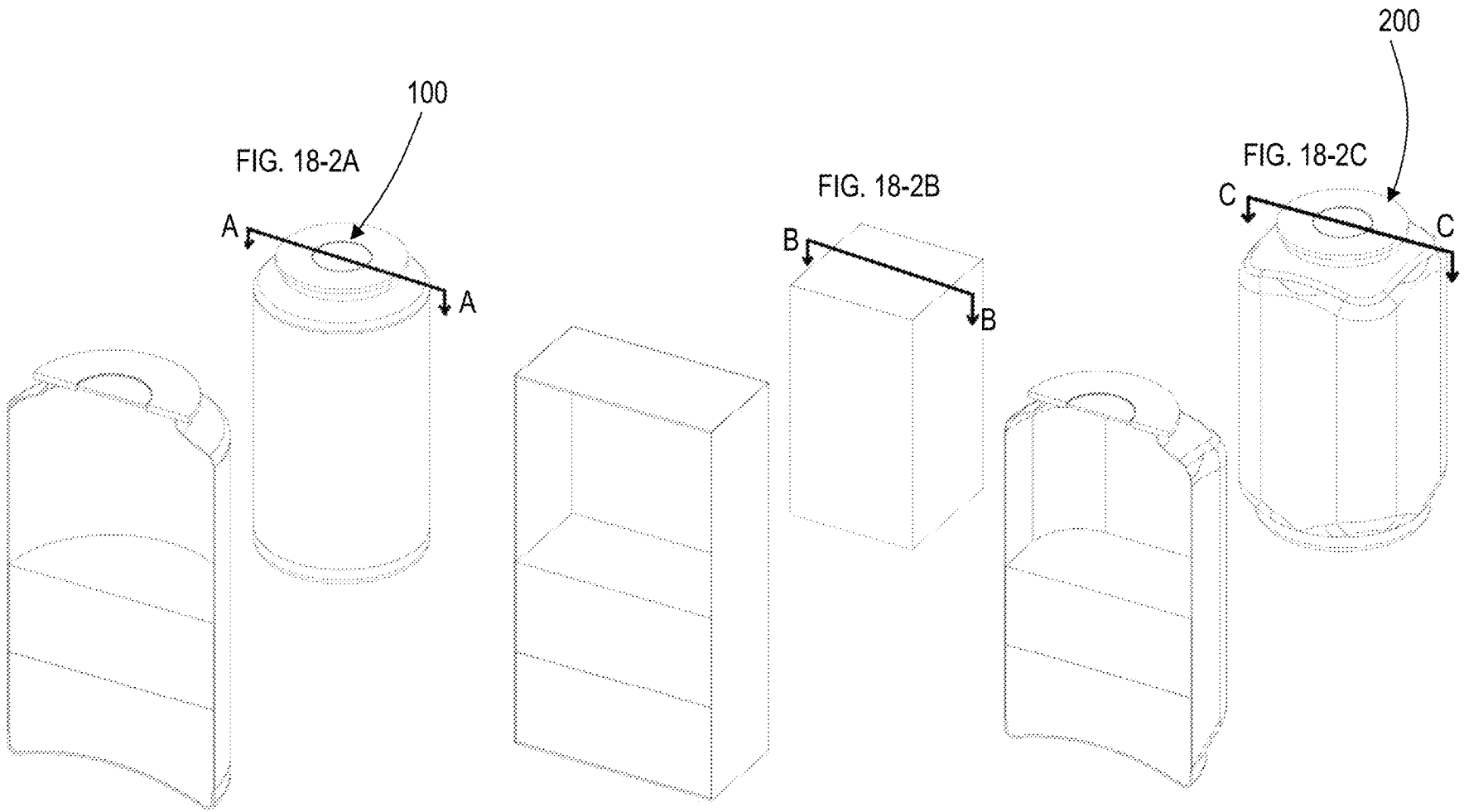
FIGS. 18-1A, 18-1B, and 18-1C are cut away perspective views along lines A-A, B-B, and C-C of FIGS. 18-2A, 18-2B, and 18-2C respectively.

Example 3. In comparison to Examples 1 and 2, an embodiment of the present disclosure, illustrated in FIG. 16C, may have a volume to surface area ratio of greater than 1 and a flow path length similar to a cylindrical container for a portion of the container defined by its perimeter walls:

Surface Area (A)=14.8 $ft^2$
Volume (V) equal to 15.1 $ft^3$
V/A ratio=1.06
L=2.1 ft V/A may be a function of radius (re) of the vertical edges of the container. Continuing the above example, a container having a 4 ft by 4 ft displacement (the packing size of the container), V/A may be optimized based on the corner radius $r_c$ as shown in FIG. 17. In this example, reduction of flow path length and increasing the ratio of volume to surface area may lead to an increased pour rate of only 10% above the cylindrical container in Example 1 such that the molten material is capable of travelling the flow path length. In this example, a pour rate of 24-35 kg/min of molten glass resulted in molten glass capable of travelling the flow path length. The radius of curvature of the sidewalls ($r_s$) may be optimized based on the material of the container and wall thickness. An optimum radius of the sidewalls may be the minimum radium (to maximize container volume) that reduces stress and distortion in the container to within the maximum allowable values of the container design code, for example American Society of Mechanical Engineers (ASME) standards for boiler and pressure vessels. The distance the glass has to flow for the round container is 2 ft (per Example 1), for the square container it is 2.8 ft (for Example 2), and for the container it is 2.1 ft. For the round container a glass flow rate of at least 24 kg/min is required. To provide similar performance the flow into the square container must be at least 33.6 kg/min and for the application container it would be 25.2 kg/min. This demonstrates that for a volume increase by a factor of 1.20 for the container of the present disclosure over the cylindrical container (Example 1), the glass flowrate is only increased by a factor of 1.05. Comparatively a volume increase of 1.27 for the square container (Example 2) with respect to the cylindrical container (Example 1) requires a proportionally larger glass flowrate by a factor of 1.4.

As discussed above with reference to Example 3, rounded convex edges of the container may provide a benefit of an increased container volume (associated with square containers) relative to surface area, without incurring the penalty of having to increase molten material pour rates to fill the square containers. The relative reduction in surface area per unit of molten glass using rounded convex edges in comparison to squared edges may allow for decreased pour rates in comparison to cylindrical and square containers. Example 3 also demonstrates that similar flow path lengths may be achieved in comparison to cylindrical containers (see Example 1) while increasing volume of the container. As such, molten material may have a shorter flow path length per unit increase in volume, and may have similar flow path lengths as a cylindrical container having a round cross-section.

In an example, the pour rate of molten material and the maximum packing volume of the container may be limited for an industrial facility. The limitations may be related to the capabilities of container handling equipment to handle larger equipment, and the material limitations of the container set by container design code, e.g. ASME standards for boiler and pressure vessels. The maximum packing volume of the container may be optimized using a container according to the present disclosure by selection a radius of curvature (r) of a vertical edge 204 of the container 200 which maximizes the volume to surface area ratio of the container and yields a flow path length which permits the molten material to reach the furthest wall from the point at which the molten material is poured into the container. In an example, the flow path length may be a distance in a horizontal plane between the point at which the molten material is poured into the container and the furthest wall. The radius $r_s$ of walls 201, 202, and 203 may be configured to provide the maximum internal volume permitted by container design code.

The container of the present disclosure may also improve resistance to mechanical stresses associated with the shape of the square container as described elsewhere in this application.

Example 4. Example containers were tested to compare deformation, strain, and stress of a cylindrical container, a rectangular prismatic container having a square cross-section, and an embodiment of the present disclosure denoted as "Concept V1", each illustrated in FIGS. 18A-2, 18B-2, and 18C-2 respectively, using a finite element analysis (FEA) model. FIGS. 18A-1, 18B-1, and 18-1C are each cut away perspective alone the lines A-A, B-B, C-C in FIGS. 18A-2, 18B-2, and 18-2C respectively. The geometry details, such as head design, and wall thickness were kept the same between all models, with the primary difference being the wall design (i.e. cylindrical, square/box, or the example embodiment of the present disclosure denoted as Concept V1). The design of Concept V1 is the same as illustrated in FIGS. 2-5 which have convex edges. Deformation, strain, and stress were evaluated at five different instances during the loading process which include:

1. Steady state temperature profile for 105° F. reached for initial condition;
2. First glass pour is added to the canister(s) approximately 25% fill at 1150° C. (2102° F.);
3. First glass pour cooling for 4 hours;
4. Second glass pour is added, approximately 50% fill at, 1150° C. (2102° F.); and
5. Second glass pore is left to cool for 4 hours.

The results of the FEA model are shown in Table 1 which illustrate the maximum evaluated deformation, strain and stress for each container. As shown in Table 1, the embodiment of FIG. 2, denoted as Concept V1, has lower maximum deformation, strain, and stress values at each load step in comparison to the Square/Box design. Concept V1 also demonstrated improved results for most load steps in comparison to the cylindrical container.

TABLE 1

Maximum Observed Deformation, Strain, and Stress Values of the Tested Canister Types

| Load Step | Canister Type | Max Deformation (in) | Max Strain (in/in) | Max Stress (ksi) |
|---|---|---|---|---|
| 1 | Cylindrical | 0.033 | 0.0000 | 1.09 |
| 105 F. initial | Square/Box | 0.038 | 0.0052 | 127.04 |
| condition | Concept V1 | 0.028 | 0.0010 | 27.09 |
| 2 | Cylindrical | 0.625 | 0.0248 | 694.70 |
| 25% glass fill | Square/Box | 0.550 | 0.0819 | 2260.60 |
| at 1150° C. | Concept V1 | 0.232 | 0.0289 | 810.04 |
| 3 | Cylindrical | 0.422 | 0.0284 | 703.87 |
| 4 hours 25% | Square/Box | 0.244 | 0.0267 | 739.38 |
| fill cooling | Concept V1 | 0.145 | 0.0118 | 309.07 |
| 4 | Cylindrical | 0.819 | 0.0290 | 707.79 |
| 50% glass fill | Square/Box | 0.745 | 0.0940 | 2587.10 |
| at 1150° C. | Concept V1 | 0.396 | 0.0220 | 607.34 |
| 5 | Cylindrical | 0.454 | 0.0256 | 631.24 |
| 4 hours of 50% | Square/Box | 0.399 | 0.0300 | 828.26 |
| fill cooling | Concept V1 | 0.241 | 0.0085 | 236.46 |

A method of filling a container with molten material from an industrial facility according to the present disclosure is described below.

The method may being with positioning the container under a discharge location of a melter. In an embodiment, the container may be positioned under the melter with a crane and a loading container what lifts the container to the melter. The container may be coupled to the melter by a locking assembly to secure the container relative to the melter. Molten material (e.g. molten glass) may then be poured from the melter into the container at a rate equal to or greater than a minimum rate required for the molten material to travel a flow path length. The flow path length is a distance between the point at which the molten material is poured and a furthest sidewall. The minimum rate require for the for the molten material to travel a flow path length is a function of the viscosity of the molten material and its temperature. In an embodiment, the molten material is poured generally along a longitudinal axis of the container, and the distance of the flow path length is approximately from the longitudinal axis of the container to the furthest wall. The rate at which molten material poured into the container may have a maximum rate defined by maximum allowable stress, strain, and distortion values permitted by design code. In an embodiment, the rate at which molten material is selected based on at least one of the flow path length, a volume to surface area ratio of the container, a radius of curvature of a vertical edge of the container, viscosity and temperature of the molten material, or a combination thereof.

A method of manufacturing a container according to the present disclosure is described below.

The manufacture of the container may begin with the first head and the second head, which, in some embodiments, are complex transition pieces (e.g., transitioning from square to round). In an embodiment, the first and second heads are each formed by hydroforming a single sheet of metal. The first head may be shaped as a tapered shoulder to smoothly transition from the first flange to the junction with the walls. The use of hydroforming allows the shape of each of the heads to be achieved with a single operation rather than multiple stamping steps, and provides for minimum thinning of the metal, allowing the use of thinner metal (e.g., reducing weight and material costs). The first and second heads may then be trimmed to prepare the ends of the heads for connecting with the walls of the container (e.g., by welding).

The first wall, second wall, and sidewalls (the walls forming the shell of the container), may be formed through a series of rolling/forming operations to obtain the required side profile (flat, convex, concave, or a combination thereof) and the required vertical edge radius. After forming, the edges may be trimmed and connected (e.g., by welding) to form the shell, which has the appearance of a large square tube and has a generally square cross-section (e.g., in a horizontal plane when the second end of the container faces downward). The lateral edges of the walls may have rounded convex profiles that form vertical edges of the container. The ends of the shell may then be trimmed to prepare them connection to the first head and second head.

The first flange may be cut from a sheet of material and shaped to interface with machinery that will couple with the container. The first flange may be a disc of a required diameter. An inner flange face may then be machined into the flange to provide interface surfaces for mating with a spout from which the container can receive molten material (e.g., molten glass).

The second flange may be hydroformed from a sheet of steel and trimmed to prepare it for connection to the second head.

The components of the container of the present disclosure may then be assembled. In an example, the first head, second head, shell, first flange, and second flange are connected by placing those components into a jig to properly align and restrain them during welding. The container is then formed through connecting the pieces together (e.g., by welding).

Once constructed, the container may be shipped by truck (e.g., in batches of 20 containers movable via fork truck). In comparison to the container shown in FIG. 1, the additional volume provided by a container according to the present disclosure may reduce the required number of containers by approximately 20%. The square-shaped cross-section of the containers also leads to increased efficiency in shipping, as there is less wasted space around them when compared to round cross-sectioned containers. Containers according to the present disclosure may also be less prone to shifting during shipment (e.g., tipping, rolling, etc.), making them less prone to damage and requiring less packaging for shipping.

Upon receipt of the containers at an industrial facility, the containers will undergo receipt inspection to ensure that they have not been damaged and that they meet all project requirements. The container certification package is updated with the results of the inspection, and it is placed into the document control system to allow tracking of the containers. The containers will then be transferred to the storage warehouse until required to receive molten material. The higher capacity containers of the present disclosure will reduce the number of containers that have to go through the receipt inspection process in comparison to the example shown in FIG. 1, and will take up less storage space in the warehouse due to their more efficient use of space.

In an example, to prepare a container to receive molten material, such as molten glass, the container is drawn from the warehouse and transported to the load-in area, its packaging is removed, and it is inspected to ensure that it is free from damage and does not contain foreign material. The certification package for the container is updated for this inspection and entered into the processing system for tracking. The container is then loaded through an air lock and placed into a temporary support rack to await processing. The container is moved using a remotely-operated overhead crane that picks up the container via the top flange using a remotely-operated grapple. During transport, the rounded edges of a container according to the present disclosure prevent it from becoming jammed on equipment or from "snagging" piping, hoses, cables, and/or the like.

Continuing the above example, when called for, a container according to the present disclosure may be picked-up from the storage rack and placed on the import cart. The cart interfaces with the container to prevent the container from moving relative to or falling off of the cart. The import cart may then transfer the container to a pour cave where an overhead mono-rail crane picks up the container using a grapple and places the container into a turn-table. The turn-table may contain partial height buckets or troughs in which the containers are placed. The container may then be raised to the bottom of the spout (e.g., a melter glass pour spout) to receive molten material. The container may be raised by an elevator that picks up the container. As above, the rounded edges of the generally square cross-sectioned container mitigate the risk of the container becoming jammed on equipment or from snagging on piping, hoses, cables, and/or the like.

The container is filled with molten material, such as molten glass, by pouring it from the melter. The container of the present disclosure enables a higher volume in comparison to a similarly dimensioned (e.g., height and diameter) container like that shown in FIG. 1. Since molten material may be produced at a constant rate, the rate at which each container needs to be produced is reduced as each container comprises a greater volume. The level of glass within the container is determined via infrared imaging of the external surface.

Once the container is filled, it is immediately lowered back into the turntable. The turntable may then rotate to place an empty container under the pour spout while moving the filled container to the idle station. An empty container is raised into position for filling. A temporary cover is placed over the filled container to limit the release of material from the high temperature molten material. The filled container may then sit in the turn table while the next container fills. When the turn table again rotates, the filled container is lifted from the turn table using the same crane and moved into an export cart. The filled container may then be moved for sealing and decontamination.

Continuing the above example, to seal the container it may be lifted from the export cart and placed into the weld station. An inert fill material may be added to the container to minimize any void within it. A lid may then be welded onto the container. The weld station includes a fixture to hold the filled container in position.

After sealing, the container may be moved to the decontamination station where it may be sprayed with dry-ice beads to blast contamination from its surface. The decontamination process may use a robotic arm and/or rotate the container to position a C02 nozzle proximate to the container.

After decontamination, the container may be moved to an interim storage area and placed in a storage rack to complete the cooling process and await export from the facility. In comparison to the container of FIG. 1, some of the present containers will allow for more glass to be stored in a given area due to the higher packing factor associated with square cross-sectioned containers. The cooled container may then be taken from the rack and exported through an air lock to a truck-bay, where it may be loaded into a cask for transportation to the disposal site.

At the disposal site, the containers may be removed from the cask and placed into a disposal cell in a landfill. Due to the greater packing factor of containers according to the present disclosure (e.g., in comparison to the container illustrated in FIG. 1), the overall size of the disposal cell is reduced because the containers may be packed closer together. The rounded edges and corners of the container also make backfilling the disposal cell easier as soil will flow more easily around rounded edges and corners.

Although the embodiments have been described in detail, it should be understood that various changes, substitutions, and alterations can be made herein.

Moreover, the scope of the present application is not intended to be limited to the particular embodiments of the process, machine, manufacture, composition of matter, means, methods, and steps described in the specification. As one of ordinary skill in the art will readily appreciate from the present disclosure, processes, machines, manufactures, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufactures, compositions of matter, means, methods, or steps.

As can be understood, the detailed embodiments described above and illustrated are intended to be examples only. The invention is defined by the appended claims.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of filling a container with molten material from an industrial facility, the method comprising:

positioning the container at a discharge location of a melter; and pouring molten material from the melter into the container at a rate equal to or greater than a minimum rate required for the molten material to travel a flow path length;

wherein the flow path length is a distance between a point at which the molten material is poured and a furthest sidewall of the container; and wherein the molten material is poured into the container at a rate below a maximum rate defined by maximum allowable stress, strain, and distortion values permitted by design code.

2. The method of claim 1, wherein the molten material is poured generally along a longitudinal axis of the container, and the distance of the flow path length is approximately from the longitudinal axis of the container to the furthest sidewall.

3. The method of claim 1, further comprising coupling the container to the melter.

4. The method of claim 1, wherein the rate is selected based on at least one of the flow path length, a volume to surface area ratio of the container, a radius of curvature of a vertical edge of the container, viscosity and temperature of the molten material, or a combination thereof.

5. The method of claim 1, wherein the molten material comprises molten glass.

6. A method of filling a container with molten material from an industrial facility, the method comprising:

positioning the container at a discharge location of a melter;

coupling the container to the melter; and pouring molten material from the melter into the container at a rate equal to or greater than a minimum rate required for the molten material to travel a flow path length;

wherein the flow path length is a distance between a point at which the molten material is poured and a furthest sidewall of the container.

7. The method of claim 6, wherein the rate is selected based on at least one of the flow path length, a volume to surface area ratio of the container, a radius of curvature of a vertical edge of the container, viscosity and temperature of the molten material, or a combination thereof.

8. The method of claim 6, wherein the molten material comprises molten glass.

9. A method of filling a container with molten material from an industrial facility, the method comprising:

positioning the container at a discharge location of a melter; and pouring molten material from the melter into the container at a rate equal to or greater than a minimum rate required for the molten material to travel a flow path length;

wherein the flow path length is a distance between a point at which the molten material is poured and a furthest sidewall of the container; and wherein the rate is selected based on at least one of the flow path length, a volume to surface area ratio of the container, a radius of curvature of a vertical edge of the container, viscosity and temperature of the molten material, or a combination thereof.

10. The method of claim 9, wherein the molten material comprises molten glass.

* * * * *